US006425703B1

(12) United States Patent
McDonnell et al.

(10) Patent No.: US 6,425,703 B1
(45) Date of Patent: Jul. 30, 2002

(54) WRITING ELEMENTS WHICH CONNECT TOGETHER

(75) Inventors: John S. McDonnell, Mount Evelyn; Graeme M. Keogh, Ferntree Gully, both of (AU); Douglas A. Brand, Easton, PA (US); Ching Yi Chen, Hsi-Chih (TW)

(73) Assignee: Binney & Smith Inc., Easton, PA (US)

( * ) Notice: Subject to any disclaimer, the term of this patent is extended or adjusted under 35 U.S.C. 154(b) by 0 days.

(21) Appl. No.: 09/797,495

(22) Filed: Mar. 1, 2001

(51) Int. Cl.[7] ..... B43K 27/04; B43K 27/08
(52) U.S. Cl. ..... 401/34; 401/35
(58) Field of Search ..... 401/34, 35, 52, 401/195

(56) References Cited

U.S. PATENT DOCUMENTS

| | | | |
|---|---|---|---|
| 1,226,992 | A | 5/1917 | Paulus |
| 2,285,000 | A | 6/1942 | Wallace |
| 2,510,302 | A | 6/1950 | White |
| 2,662,335 | A | 12/1953 | Calverley |

(List continued on next page.)

FOREIGN PATENT DOCUMENTS

| | | | |
|---|---|---|---|
| AU | A-21207/92 | | 2/1991 |
| DE | 25 55 315 | | 7/1977 |
| DE | 3914290 | C1 | 2/1991 |
| EP | 0 395 797 | A1 | 11/1990 |
| EP | 0 856 419 | A1 | 8/1998 |
| JP | 09-173656 | | 7/1997 |
| WO | WO 97/21475 | A1 | 6/1997 |
| WO | WO 99/47223 | A1 | 9/1999 |

OTHER PUBLICATIONS

Photographs and photocopies of Faber–Castell, 20 Connector Pens, available to applicant before Mar. 2000.

Photographs of Faber Castell, Prestocolor pens, available to applicant before Mar. 2000.

Photographs of Snap Sticks by Binney & Smith, 1992.

Brochure for Goldfaber 1500 markers by Faber–Castell, approximately 1991.

*Primary Examiner*—Gregory L. Huson
*Assistant Examiner*—Tuan Nguyen
(74) *Attorney, Agent, or Firm*—Leydig, Voit & Mayer, Ltd.

(57) ABSTRACT

A set of combined construction toy and marker bodies. Each marker (50) includes ball portions (58, 60) and socket portions (62, 64) that receive the ball portions (58, 60). The construction facilitates a pivoting, rotatable interconnection between markers. All of the markers (50) may also consist of an identical shape. Each marker (50) may further include a separable cap (54) that incorporates a ventilated end (132) to allow fluid passage therethrough, so as to provide an air passageway (130) through the cap (54).

18 Claims, 27 Drawing Sheets

U.S. PATENT DOCUMENTS

| | | | | |
|---|---|---|---|---|
| 2,714,269 | A | | 8/1955 | Charles |
| 2,752,726 | A | | 7/1956 | Calverley |
| 2,793,617 | A | | 5/1957 | Palmer |
| 2,909,867 | A | | 10/1959 | Hobson |
| 2,972,833 | A | | 2/1961 | Grutta |
| 3,102,742 | A | | 9/1963 | Shurcliff |
| 3,212,146 | A | | 10/1965 | Morgan |
| 3,475,023 | A | | 10/1969 | Fauvelle |
| 3,597,874 | A | | 8/1971 | Ogsbury |
| 3,654,726 | A | | 4/1972 | Witte |
| 3,747,261 | A | | 7/1973 | Salem |
| 3,810,550 | A | | 5/1974 | Longarzo |
| D241,107 | S | | 8/1976 | Ferrara, Jr. et al. |
| 4,012,155 | A | | 3/1977 | Morris |
| 4,169,332 | A | | 10/1979 | Fischer |
| 4,193,495 | A | | 3/1980 | Keeley |
| D256,292 | S | | 8/1980 | Cox |
| D256,963 | S | | 9/1980 | Harrington |
| 4,253,268 | A | | 3/1981 | Mayr |
| 4,501,358 | A | | 2/1985 | Zinbarg |
| 4,617,001 | A | | 10/1986 | Parein |
| D291,947 | S | | 9/1987 | Nakata |
| 4,702,633 | A | * | 10/1987 | Schmidt ..... 401/35 |
| 4,736,838 | A | | 4/1988 | Nakata et al. |
| 4,738,558 | A | | 4/1988 | Hiromori |
| 4,738,648 | A | | 4/1988 | Berndt |
| D299,359 | S | | 1/1989 | Cain |
| 4,858,980 | A | | 8/1989 | Dreisig et al. |
| 4,875,591 | A | | 10/1989 | Mikesell |
| 4,936,469 | A | | 6/1990 | Drower |
| 4,947,527 | A | | 8/1990 | Hennig |
| D313,818 | S | | 1/1991 | Moore |
| 5,000,804 | A | | 3/1991 | Isoda |
| 5,037,224 | A | | 8/1991 | Wright |
| 5,044,804 | A | | 9/1991 | Chuang |
| 5,194,031 | A | | 3/1993 | Sahler |
| D345,581 | S | | 3/1994 | Popovits |
| 5,310,376 | A | | 5/1994 | Mayuzumi et al. |
| 5,326,068 | A | | 7/1994 | Spears |
| 5,368,514 | A | | 11/1994 | Glickman et al. |
| 5,375,726 | A | | 12/1994 | Lechleiter |
| D365,850 | S | | 1/1996 | Romans |
| 5,484,066 | A | | 1/1996 | Luisi |
| D369,160 | S | | 4/1996 | Gotoh et al. |
| 5,531,625 | A | | 7/1996 | Zhong |
| 5,570,794 | A | | 11/1996 | Drower |
| 5,769,681 | A | | 6/1998 | Greenwood, Sr. et al. |
| 5,897,417 | A | | 4/1999 | Grey |
| 6,086,445 | A | | 7/2000 | Zawitz |
| 6,149,330 | A | * | 11/2000 | Chuang ..... 401/34 |
| 6,161,975 | A | * | 12/2000 | Clarke ..... 401/34 |

* cited by examiner

WRITING ELEMENTS WHICH CONNECT TOGETHER

FIELD OF THE INVENTION

This invention relates generally to the field of elements which connect together, and more particularly concerns writing devices which connect together.

BACKGROUND OF THE INVENTION

Drawing tools such as colored pencils, crayons, markers, and the like, satisfy creative and developmental needs of children. Construction toys, widely used by children as a playtime staple, can also be educational, and stimulate a child's imagination while satisfying a need for creative expression.

It would be desirable for markers to be combined with construction elements, which can be used to create three-dimensional figures and models. Thus, two popular forms of children's self-expression could be combined to allow an easy, seamless transition between two-dimensional and three-dimensional modes of expression.

The invention provides such a device. These and other advantages of the present invention, as well as other additional inventive features, will be apparent from the description of the invention provided herein.

SUMMARY OF THE INVENTION

The invention provides for a set of markers which connect together and which may utilize a pivoting ball-and-socket connection between individual markers. In one embodiment, individual markers may include ball portions and socket portions disposed at both of their ends. The connections may then be formed by snapping a ball portion into a socket portion, resulting in a pivoting, rotatable connection.

Each individual marker may consist of a body, an end plug, an ink reservoir, a writing nib, and a removable cap. In one embodiment, the cap includes at least one ball portion. The end plug of this embodiment is receivable within an open end of the marker body and includes at least one socket portion that receives a ball portion as described above. In other embodiments, the design of the cap and end plug allows for the connection of multiple markers at the end of each marker.

The marker cap may also be ventilated so as to provide an air passageway through the cap in the event the cap becomes lodged in a child's throat.

Other objects and advantages of the invention will become apparent upon reading the following detailed description and upon reference to the drawings in which:

DESCRIPTION OF THE INVENTION

Figure 1:
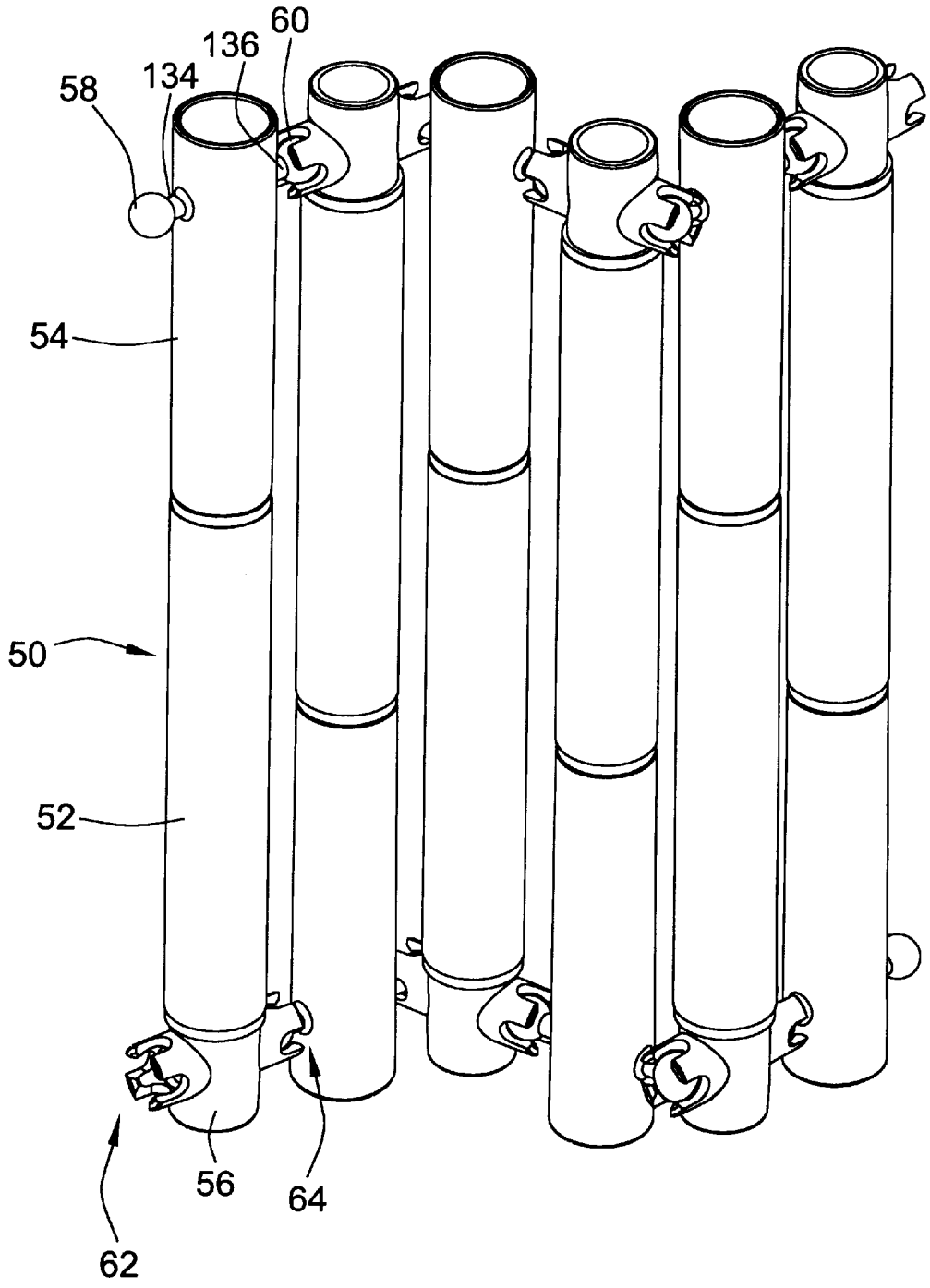
FIG. 1 is a perspective view of a plurality of markers linked together according to an embodiment of the present invention.

A plurality of connectable markers constructed in accordance with the teachings of the invention is illustrated in FIG. 1. According to the teachings of the invention, each marker 50 may include a body 52, a cap 54, and an end plug 56. The caps 54 and end plugs 56 of each marker 50 may include mating connectors that facilitate flexible, rotatable interconnection between individual markers 50.

Referring further to FIG. 1, there is shown an illustrative embodiment of the invention wherein a plurality of markers, each including a cap 54 and an end plug 56, are linked together. According to this embodiment, the connection between individual markers is made when a ball portion 58, 60, attached to the cap 54 of one marker 50 is received within a socket portion 62, 64, built into the end plug 56 of another. A ball-and-socket connection provides a flexible, rotatable arrangement that allows the construction of a wide range of three-dimensional figures, or simply the bundling of a group of markers together for storage and transport.

Figure 2:
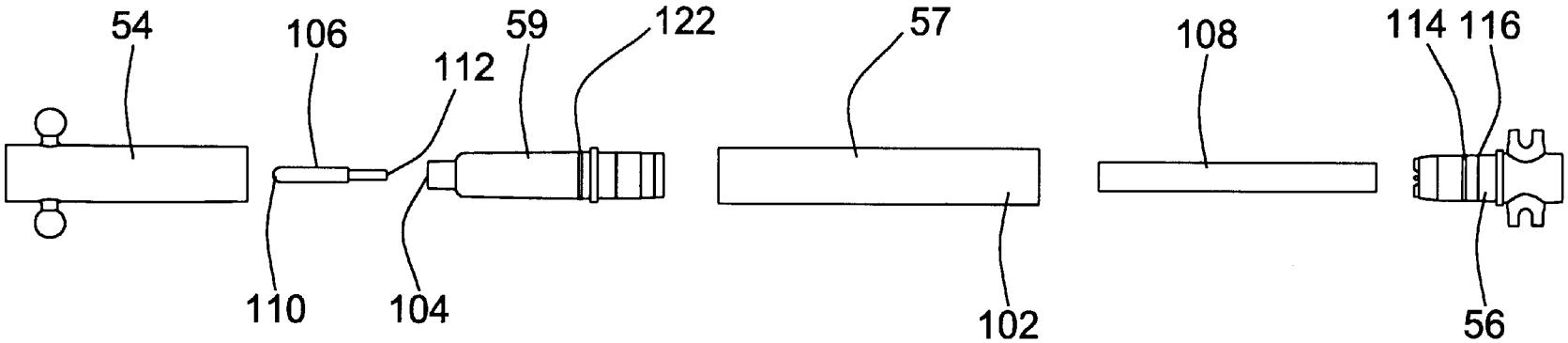
FIG. 2 is an exploded side elevational view of an individual marker assembly.

In keeping with this embodiment of the invention, each marker 50 is a writing device. As is shown in FIG. 2, each individual marker includes a body 52, a cap 54, and an end plug 56. In this embodiment, the body 52 includes a barrel 57 and a collet 59. The body 52 includes an open end 102 and a drawing end 104. The drawing end 104 receives a nib 106, and the open end 102 of the body 52 receives an ink reservoir 108. The nib 106 further includes a writing end 110 and a contacting end 112 that engages the reservoir 108, thus creating a path for ink to flow from the reservoir 108 through the nib 106 when the writing end 110 contacts a writing surface.

Figure 9:
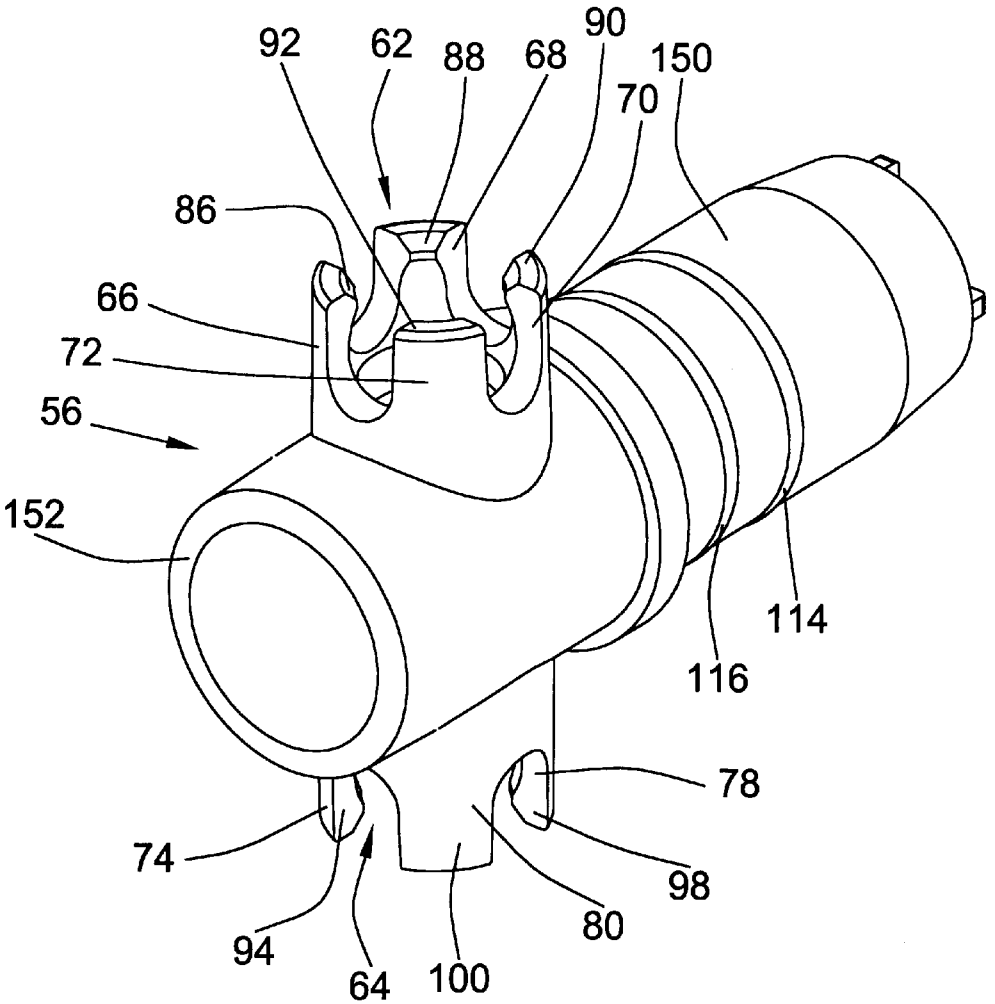
FIG. 9 is a perspective view of a marker end plug according to the present invention.
Figure 10:
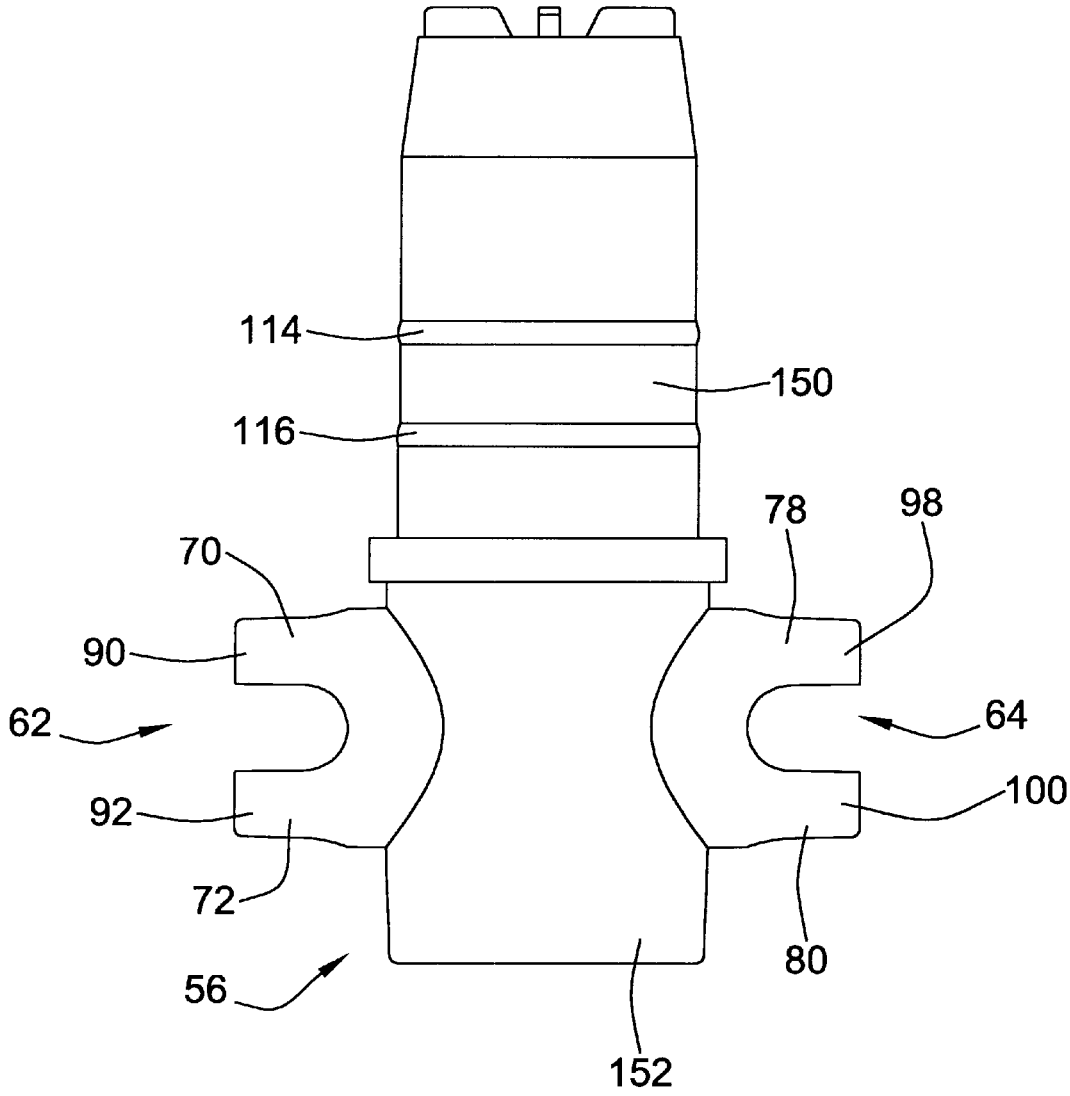
FIG. 10 is a side elevational view of the marker end plug shown in FIG. 9.

In this embodiment, the end plug 56 of the marker assembly 50 is received within the open end 102 of the marker body 52. The end plug 56 seals the open end 102 of the marker body 52, which contains the ink reservoir 108. Referring to FIGS. 9 and 10, the end plug 56 includes annular ridges 114, 116 that engage the interior of the open end 102 of the marker body 52, to secure and seal the end plug 56 within the marker body 52. The marker body 52 is thus sealed, to prevent the ink in the reservoir 108 from evaporating.

FIG. 2 also illustrates the end cap 54 of this embodiment, which receives the drawing end 104 of the marker body 52. The cap 54 functions to protect the nib 106 and to prevent the marker ink from evaporating when the marker is not in use. As is more clearly seen in FIG. 7, the cap 54 includes an interior annular ring 120 that interlocks with a corresponding annular ring 122, seen in FIG. 2, on the exterior of the drawing end 104 of the marker body 52. The engagement of the locking rings 120, 122 secures the cap 54 to the drawing end 104 of the marker body 52 when the marker assembly 50 is not in use.

Figure 3:
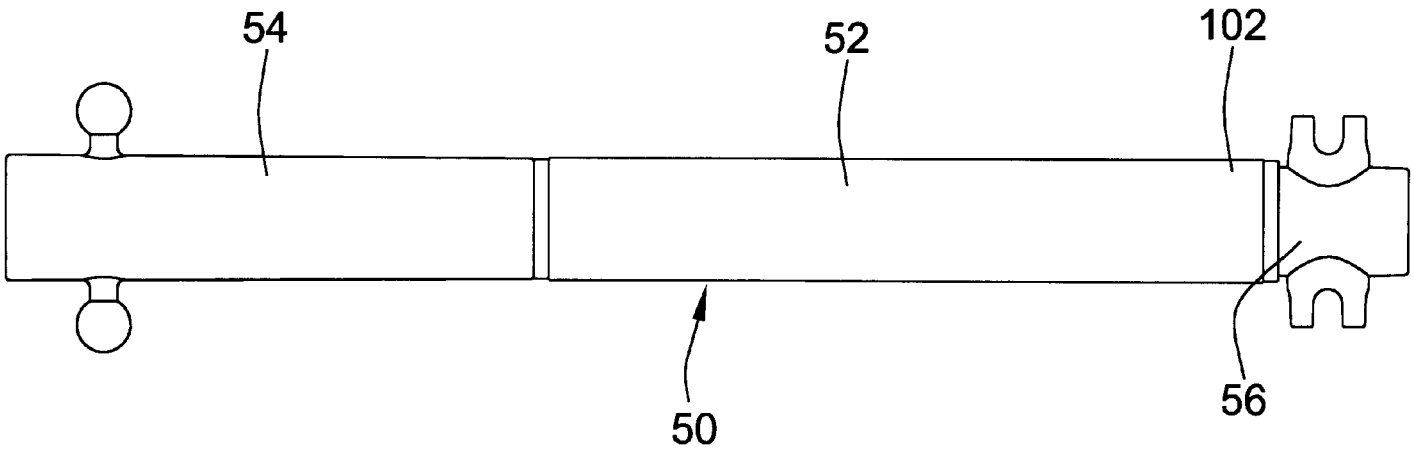
FIG. 3 is a side elevational view of an individual marker assembly.
Figure 4:
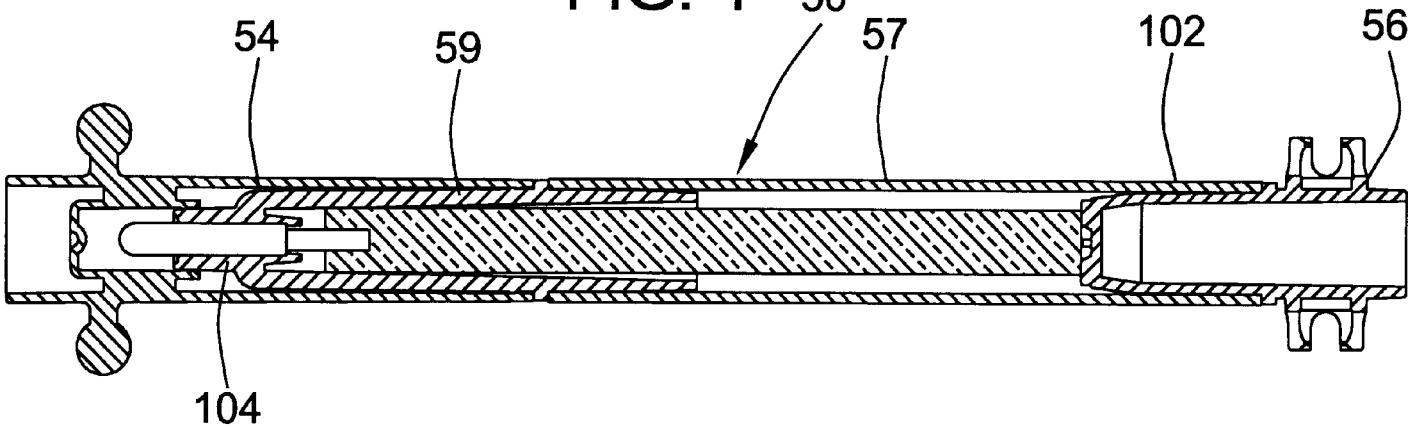
FIG. 4 is a sectional view of the individual marker assembly shown in FIG. 3.

FIG. 3 is a side view of a marker assembly 50, and illustrates the interrelationships among the assembled marker components. FIG. 4 is a sectional view of the individual marker 50 of FIG. 3. The cap 54 receives and seals the drawing end 104 of the marker body. The end plug 56 is received within the open end 102 of the marker body 52, and seals the open 102 end of the marker body 52. The cap 54 and end plug 56 prevent the ink reservoir 108 from drying out through evaporation when the marker is not in use.

Figure 5:
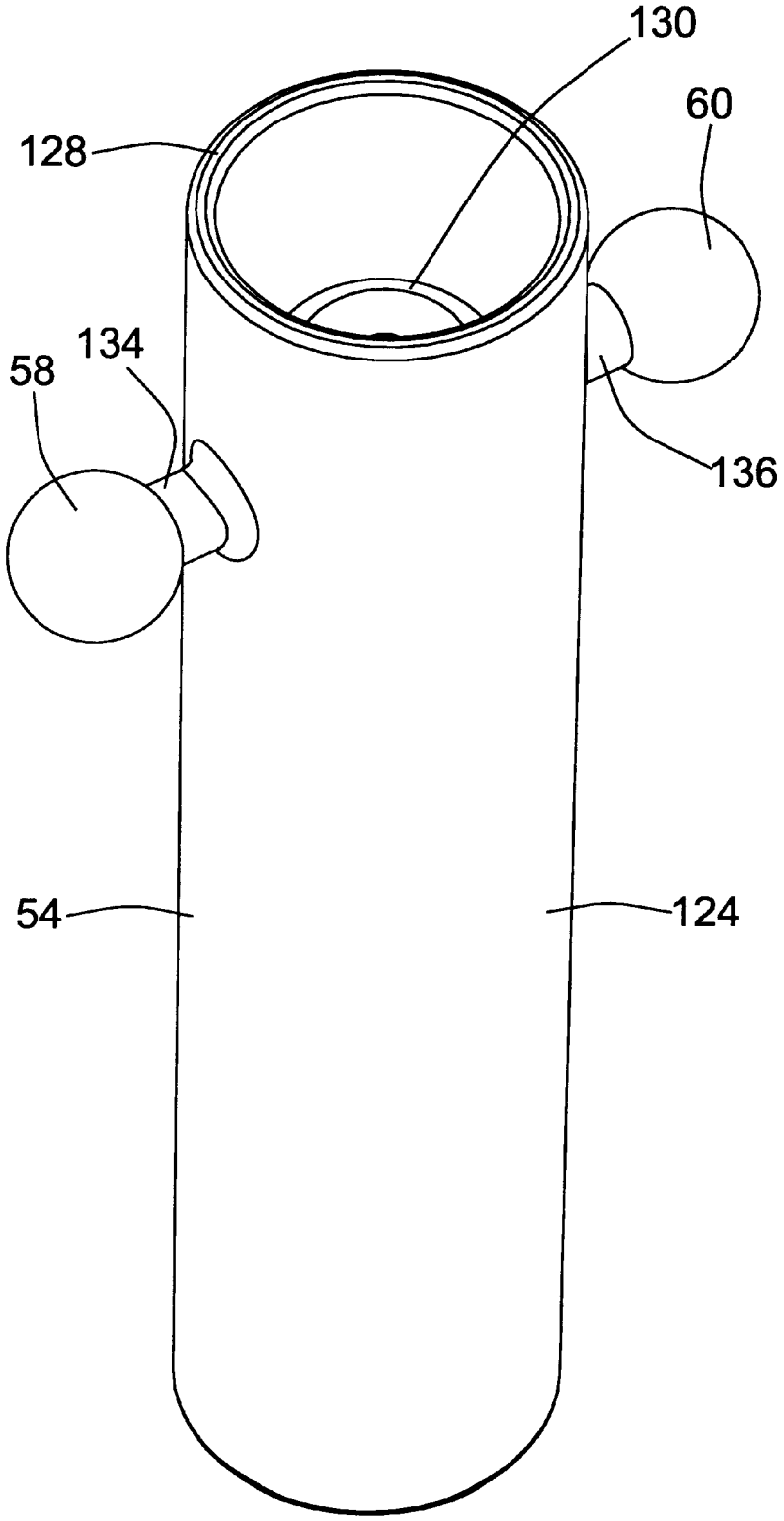
FIG. 5 is a perspective view of a ventilated marker cap, according to an embodiment of the present invention.
Figure 7:
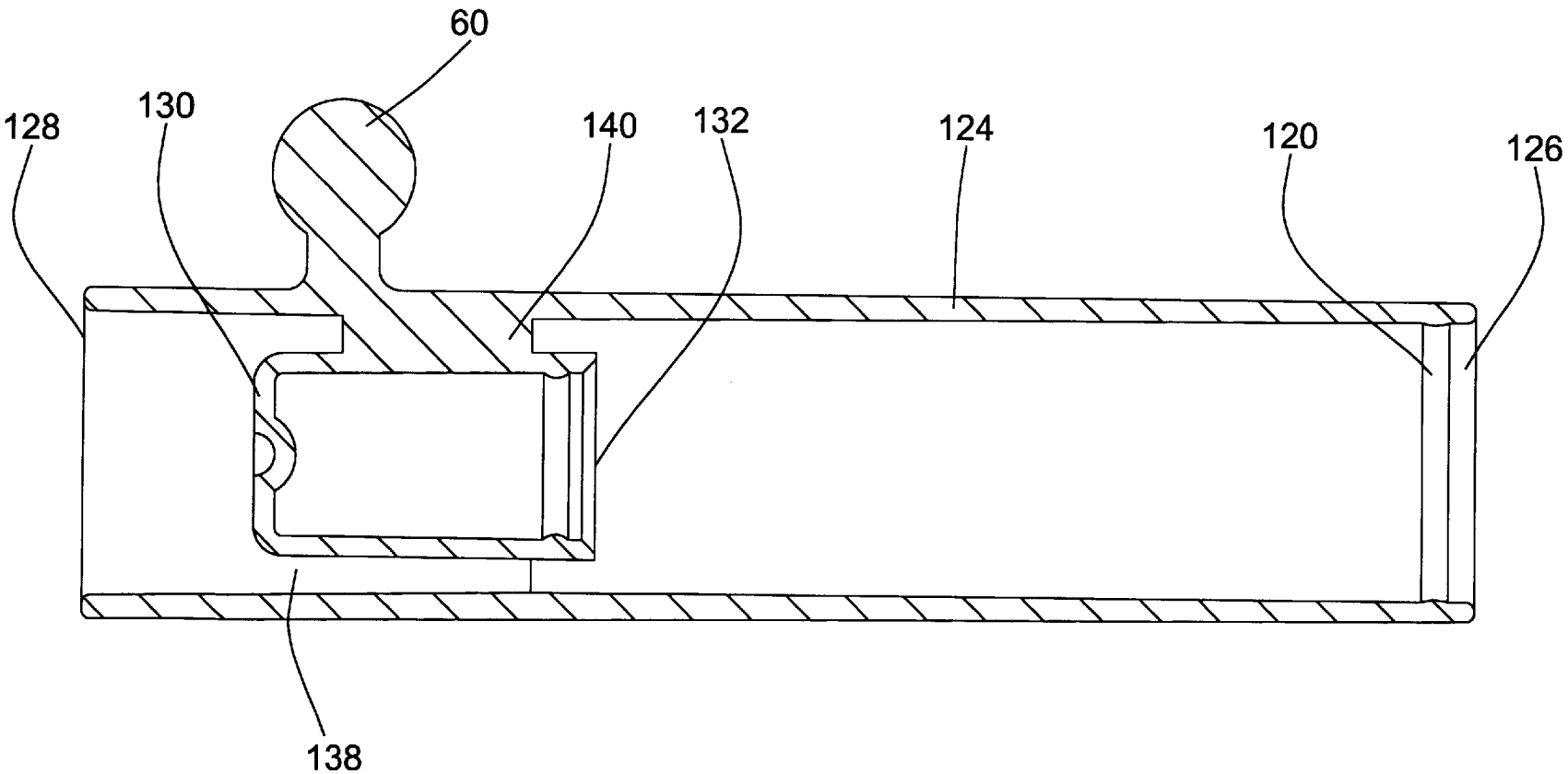
FIG. 7 is a sectional view of the ventilated marker cap shown in FIG. 5, taken along line 7—7 of FIG. 6.

As is seen in FIGS. 5 and 7, the cap 54 includes an outer cylinder 124, ball portions 58, 60, an open end 126, a vented end 128, and an inner cap 130. The ball portions 58, 60 are connected to the vented end 128 of the cap 54 by means of short pegs 134, 136. In this embodiment, the pegs 134, 136 are illustrated as cylindrically shaped. However, their shapes may vary, and are they are not limited to their configuration in this illustrative embodiment.

Figure 8:
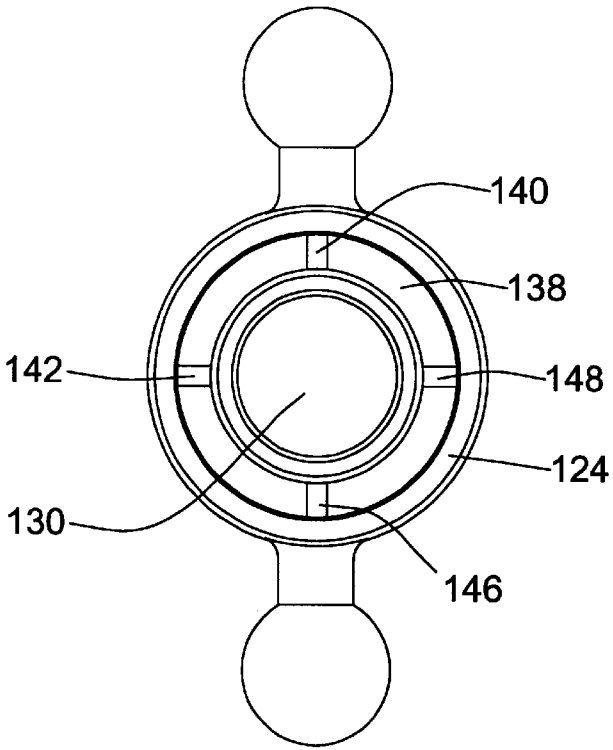
FIG. 8 is a bottom view of the ventilated marker cap shown in FIG. 5.
Figure 6:
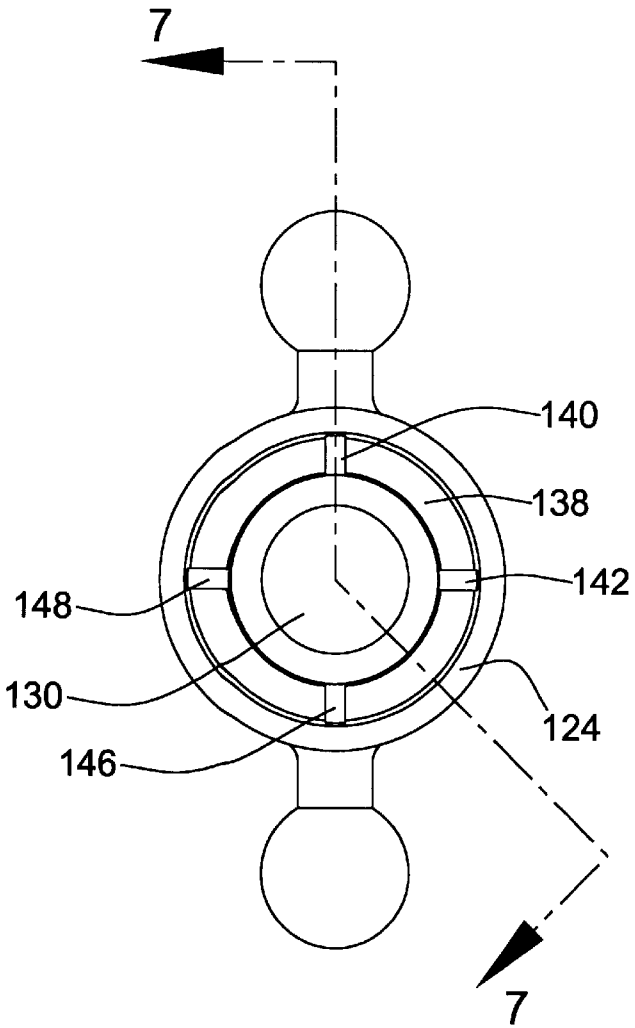
FIG. 6 is a top plan view of the ventilated marker cap shown in FIG. 5.

In this illustrative embodiment, the cap 54 may also be vented to reduce its potential choking hazard to children. If the vented cap 54 were to lodge in a child's throat, it would allow the child to safely breathe until removed. The venting may be achieved by means of a ventilation passage 138, shown in FIGS. 6–8. This passage 138 consists of the space between an inner cap 130, with an open end 132, and the outer cylinder 124, resulting from their connection in a coaxial, spaced-apart relationship by bridge portions 140, 142, 146, 148, which extend from the interior of the cap outer cylinder 124 to the exterior of the inner cap 130. FIG. 7, a sectional view along line 7—7 of FIG. 6, illustrates the connection of the inner cap 130 to the outer cylinder 124 by bridge portion 140.

In this illustrative embodiment, the inner cap 130 receives the nib 106, as the cap 54 receives the drawing end 104 of the marker body 52. This construction allows the cap 54 to protect the nib 106 and to prevent the ink from evaporating. In addition, this construction also provides a passageway for air between the inner cap 130 and outer cylinder 124, such that a child may continue breathing in the event that the cap 54 becomes lodged in the child's throat through accidental ingestion. Further, FIG. 7 illustrates an annular ring 120 disposed on the interior of the outer cylinder 124, spaced apart from the open end 126 of the cap 54. This annular ring 120 secures the cap 54 to the marker body 52 by interlocking with the annular ring 122, shown in FIG. 2, on the marker body 52 when the marker is not in use.

The illustrative embodiment also includes an end plug 56, as illustrated in FIGS. 9 and 10. The end plug 56 includes a tubular end 150 that is received within the open end 102 of the marker body 52. The annular ridges 114, 116 on the end plug 56 engage the interior of the tubular marker body 52 so as to secure the end plug 56 in place, thus sealing the open end 102 and rendering the end plug 56 difficult to remove.

The end plug 56 of this embodiment also includes two diametrically opposed sockets 62, 64. Each socket 62, 64 is defined by prongs 66, 68, 70, 72 and 74, 76, 78, 80, respectively, and each socket 62, 64 is configured to receive a ball portion 58, 60. Each prong 66, 68, 70, 72, 74, 76, 78, 80 of this particular embodiment includes a lug 86, 88, 90, 92, 94, 96, 98, 100, respectively, that protrudes toward the interior of the socket 62, 64 formed by its associated prong. The lugs 86, 88, 90, 92, 94, 96, 98, 100 partially surround, and thus rotatably lock a ball portion 58, 60 within the socket, as is clearly seen in FIG. 1. The prongs 66, 68, 70, 72, 74, 76, 78, 80 are spaced apart from one another in order to allow rotation and relative motion of coupled markers as the short pegs 134, 136 are rotated into the spaces between adjacent prongs. In the embodiment shown, the ball and socket connection offers flexibility because the spaces between the prongs 66, 68, 70, 72, 74, 76, 78, 80 allow the ball connecting pegs 134, 136 to be rotated past the ball retaining lugs 86, 88, 90, 92, 94, 96, 98, 100 of the sockets 62, 64 as the marker is rotated.

In this embodiment, the exterior of the socket 62, 64 is circular in cross-section. In other embodiments, the exterior of the socket may have other cross-sections or configurations.

According to the teachings of the invention, the actual number of sockets disposed on each end plug 56 is not limited to two, as described in this illustrative embodiment. Any number of sockets, which may ultimately be limited by production methods, may be disposed on each end plug 56. For example, the end plug may include one, three, four, five, or more sockets. Furthermore, the ball portions 58, 60 and sockets 62, 64 are not limited to the configuration described in this embodiment. The ball portions 58, 60 may also be disposed on the end plug 56, and the sockets 62, 64 may be disposed on a cap 54. Ball portions 58, 60 and sockets 62, 64 may also be disposed in various symmetrical or asymmetrical orientations relative to each other. In another alternative embodiment, each end plug 56 or cap 54 may include both ball 58, 60 and socket 62, 64 portions.

Similarly, the number of prongs or lugs defining each socket on the end plug of the illustrative embodiment is in no way meant to limit the scope or spirit of the invention.

Any number of prongs or lugs can be incorporated, while still keeping within the scope of the invention. For example, each socket may include three, five, six, or more prongs or lugs.

Figure 11:
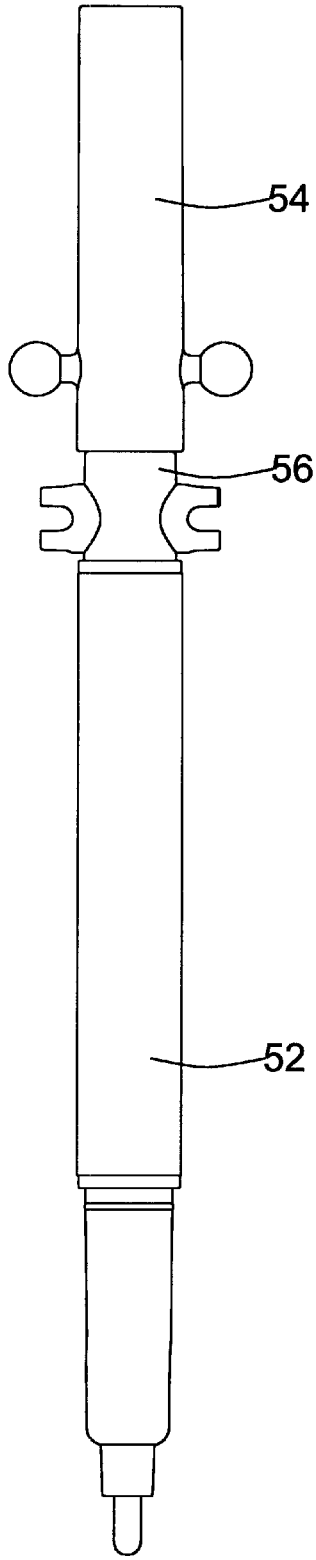
FIG. 11 is a side view of the marker with the marker cap positioned on the end plug.

As is seen in FIGS. 9 and 10, the end plug 56 of this embodiment also includes an annulet 152 that is diametrically opposed to and coaxial with the tubular end 150 of the end plug 56. The raised annulet 152 is sized so as to be slidably receivable within the open end 126 of cap 54 as shown in FIG. 11. Friction between the annulet 152 and the cap 54 retains the cap 54 in an easily accessible location when the marker 50 is used for writing or drawing. The annulet 152 is also configured to allow easy engagement and disengagement of cap 54.

FIGS. 12–15 show views of two markers 50, 51 connected together in various positions. The markers have an X axis 160, a Y axis 162, and a vertical Z axis 164. The Y axis 162 is perpendicular to the X axis 160. The vertical Z axis 164 is perpendicular to the X axis 160 and the vertical Z axis 164 is perpendicular to the Y axis 162.

Figure 12:
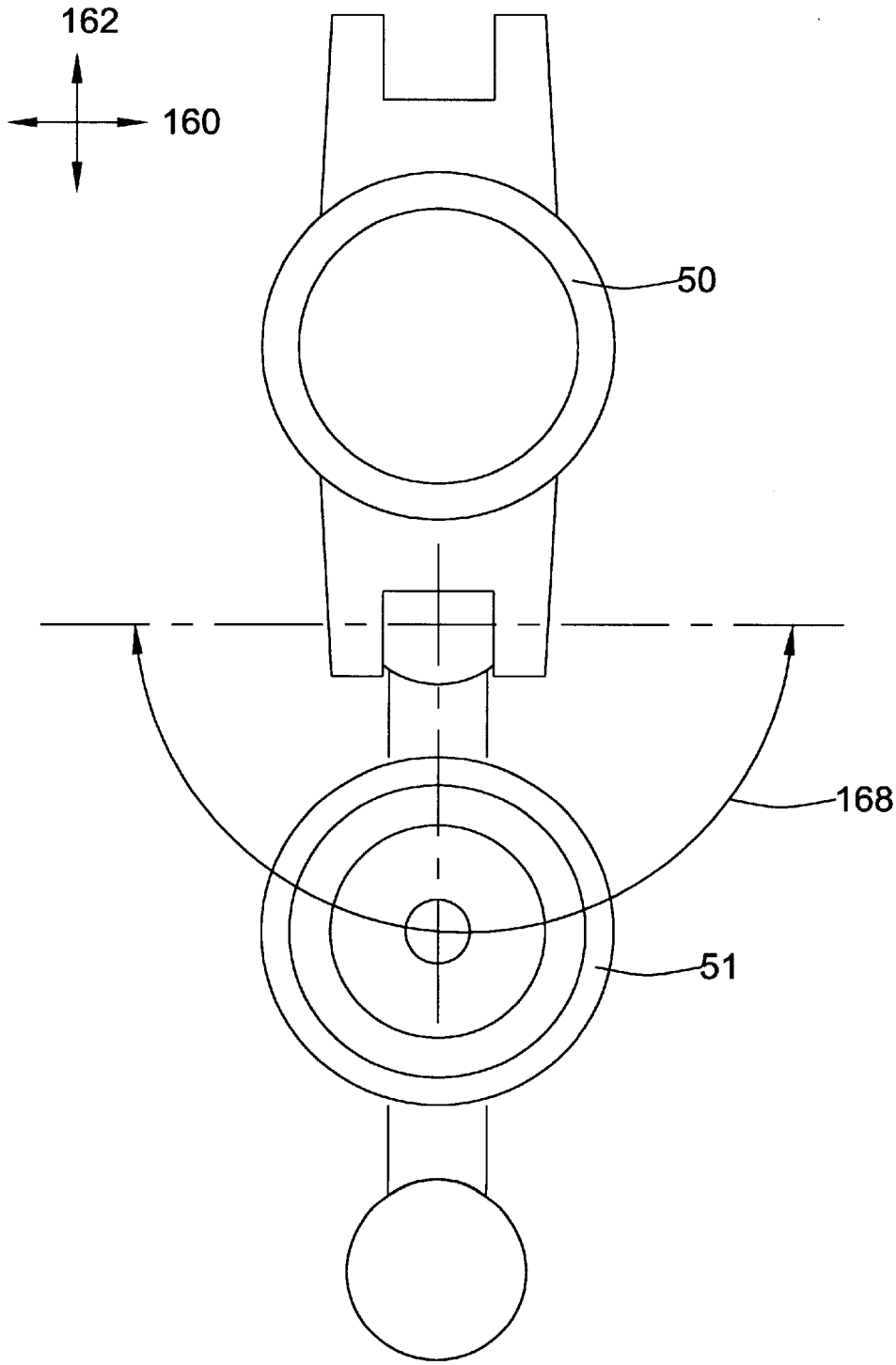
FIG. 12 is a top view of two markers connected together.
Figure 13:
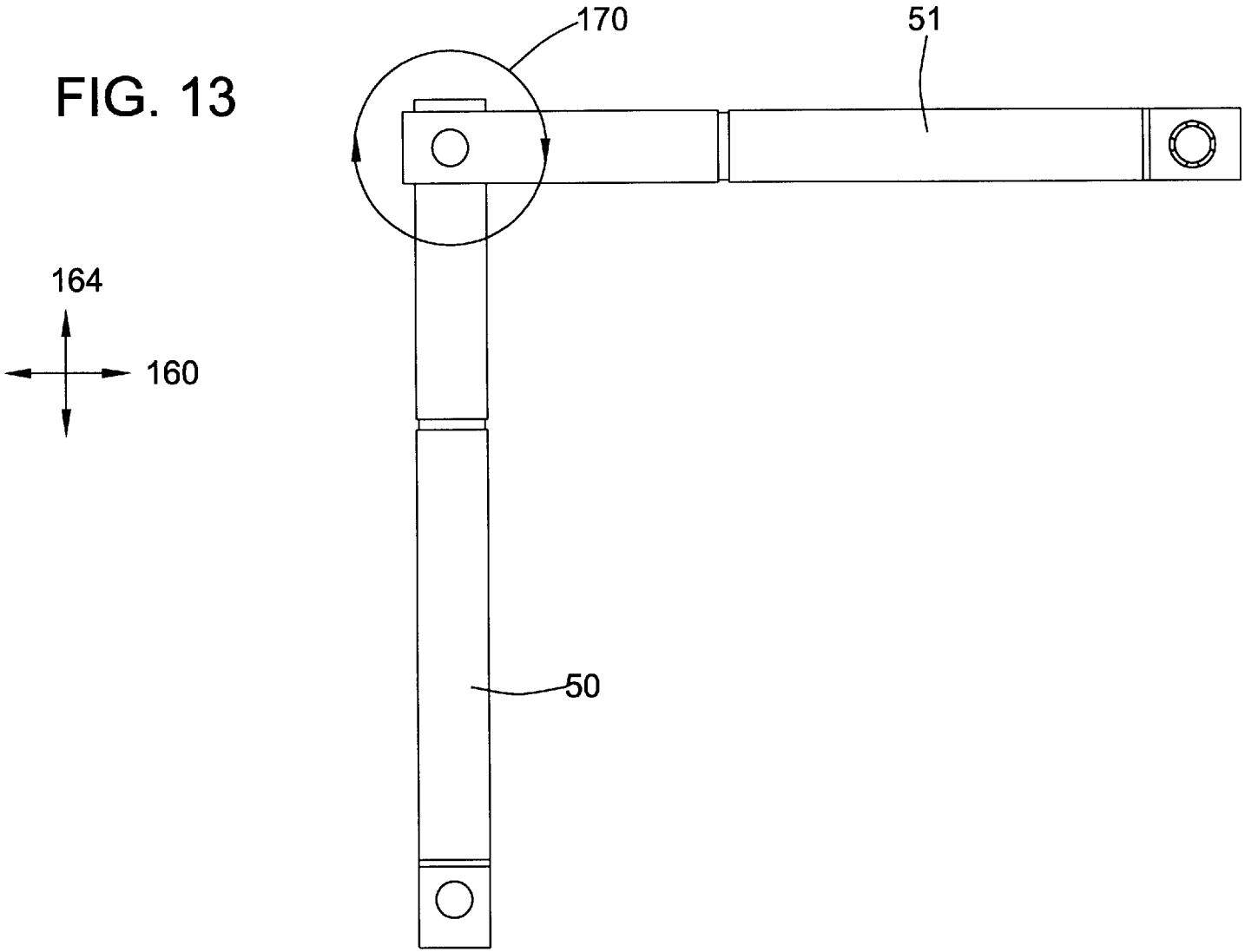
FIG. 13 is a side view of two markers connected together.
Figure 14:
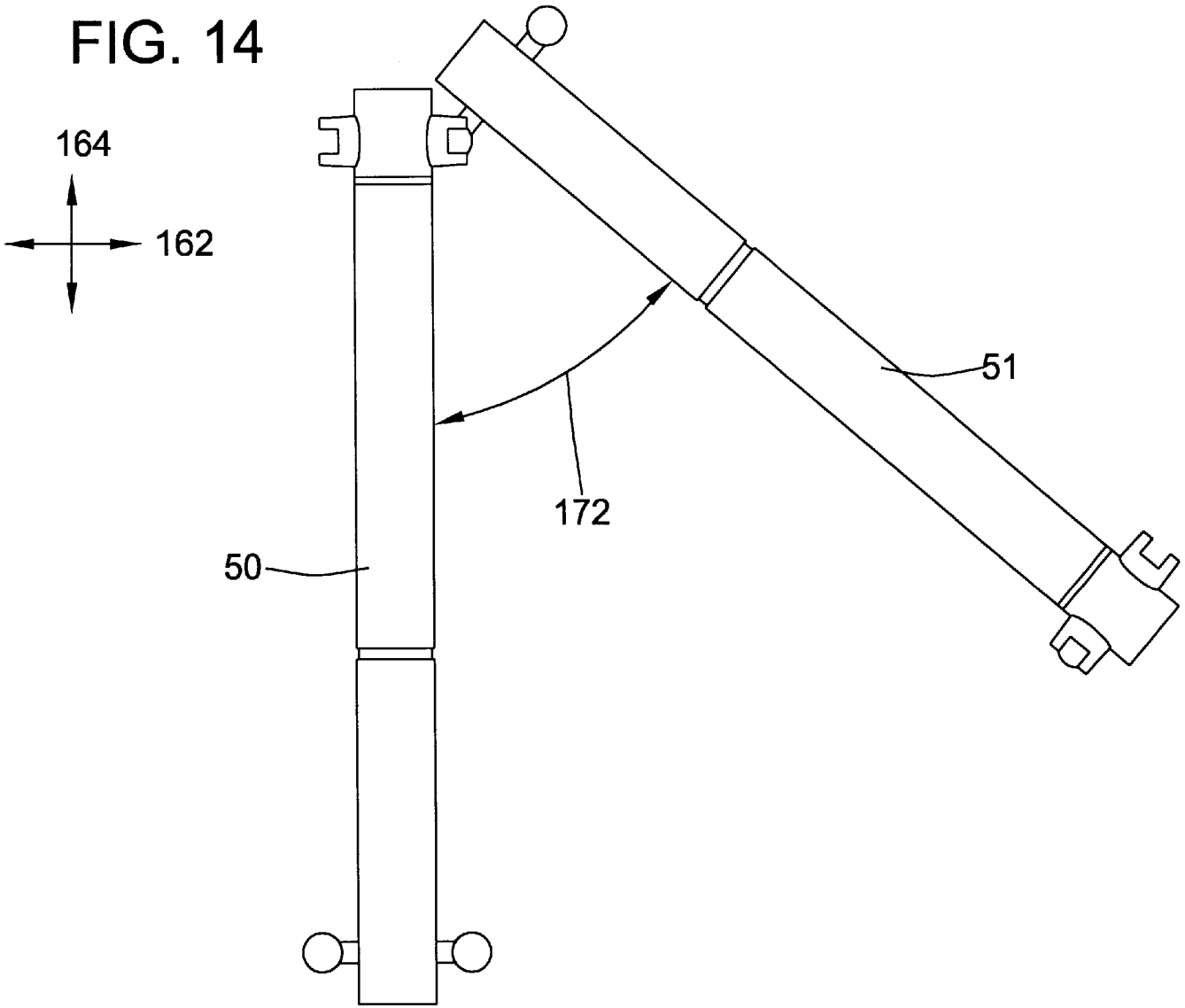
FIG. 14 is a side view of two markers connected together.
Figure 15:
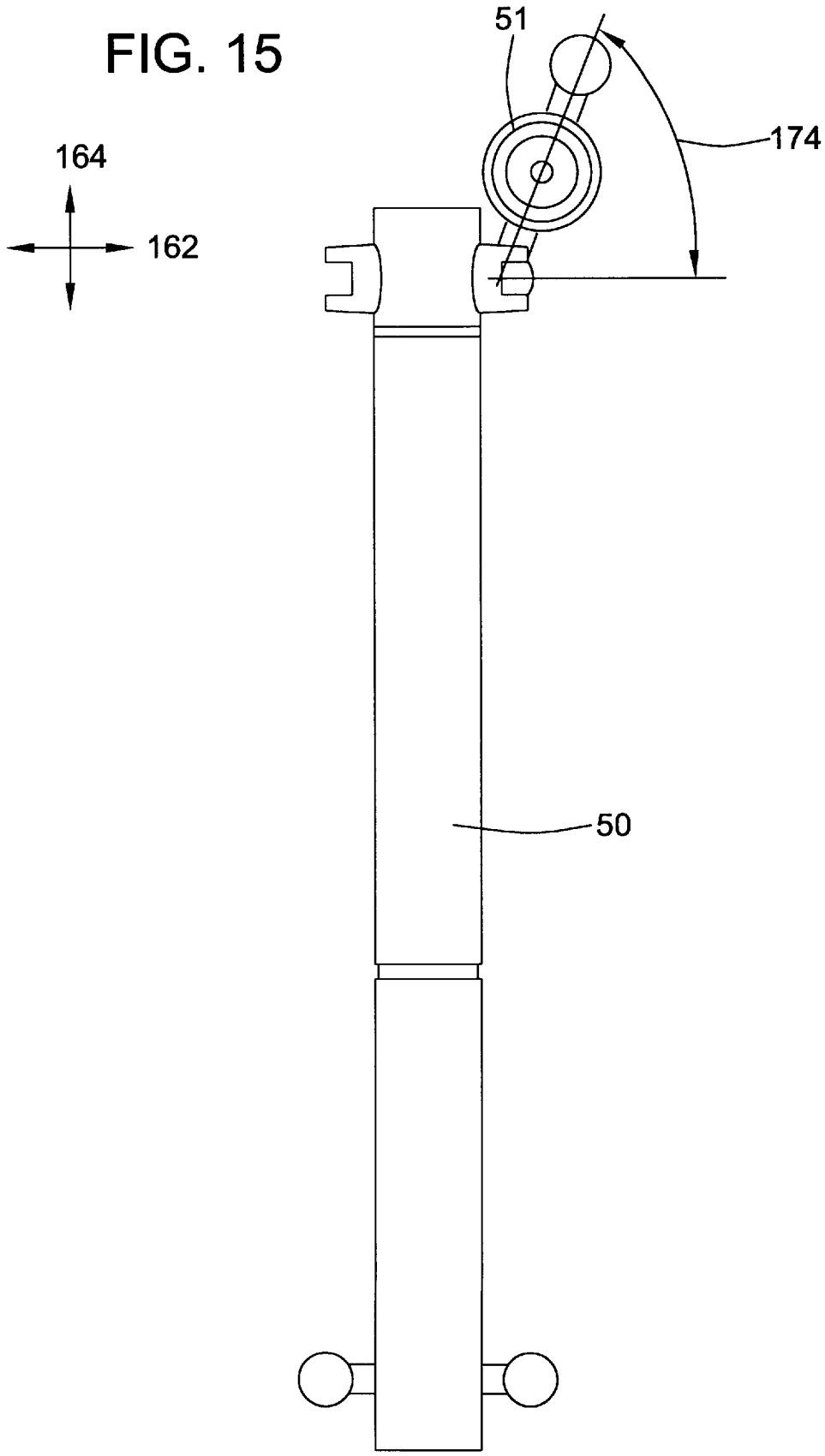
FIG. 15 is a side view of two markers connected together.

Referring to FIG. 12, the markers 50, 51 are shown in a top view. The marker 51 is able to move in a range 168 of 0 to 180 degrees around the Z axis 164 relative to the marker 50. Referring to FIG. 13, the markers 50, 51 are shown in a side view. The marker 51 is able to move in a range 170 of 0 to 360 degrees around the Y axis 162 relative to marker 50. Referring to FIG. 14, the marker 51 is able to move in a range 172 of 0 to 50 degrees around the X axis 160 (in the Y-Z plane). Referring to FIG. 15, the marker 51 is able to move in a range 174 of 0 to 70 degrees around the X axis 160 (in the Y-Z plane).

Figure 16:
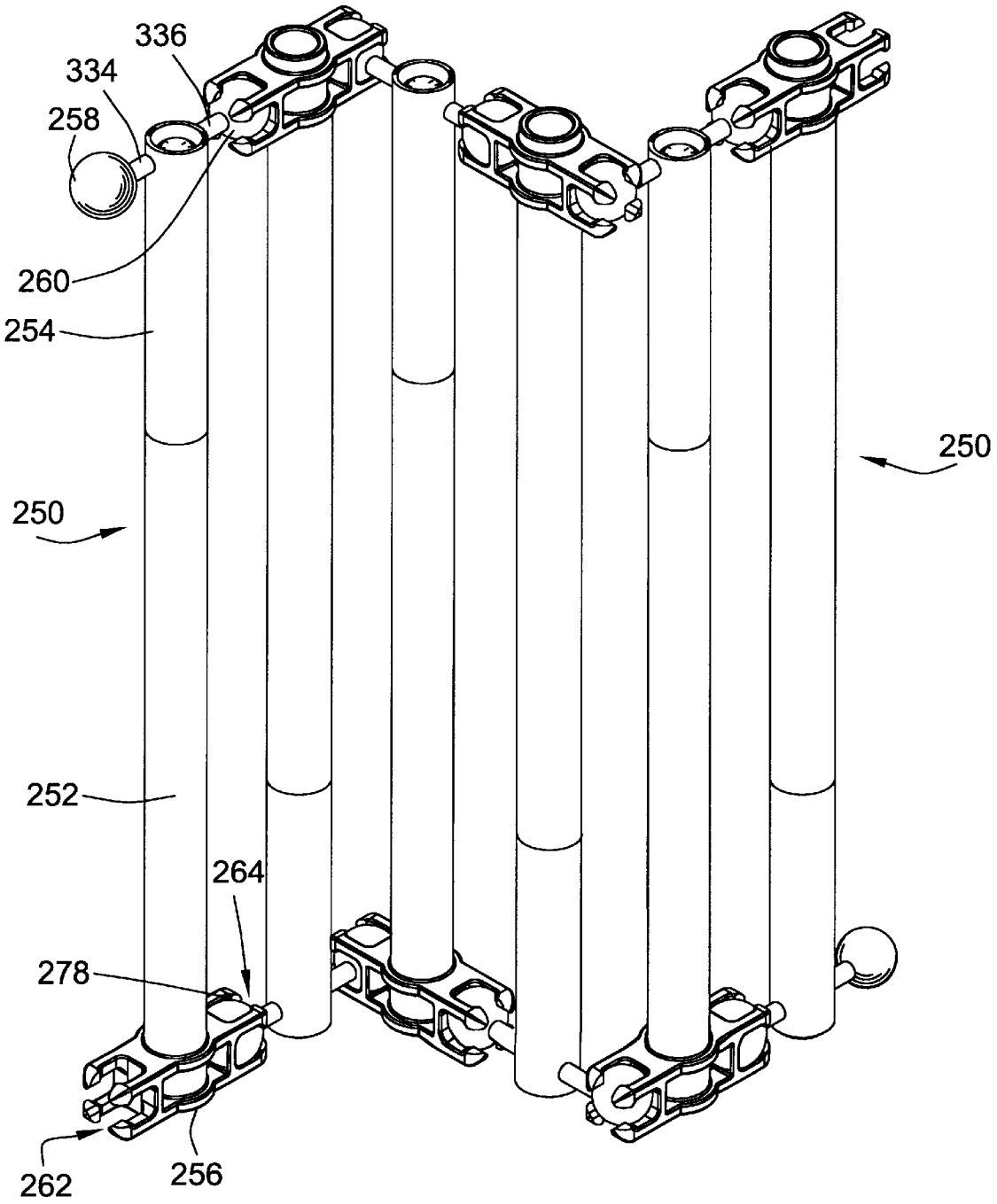
FIG. 16 is a perspective view of a plurality of markers linked together according to another embodiment of the present invention.

Another embodiment of connectable markers constructed in accordance with the teachings of the invention is illustrated in FIG. 16. According to the teachings of the invention, each marker 250 may include a body 252, a cap 254, and an end plug 256. The caps 254 and end plugs 256 of each marker 250 may include mating connectors that facilitate flexible, rotatable interconnection between individual markers 250.

Referring further to FIG. 16, there is shown an illustrative embodiment of the invention wherein a plurality of markers, each including a cap 254 and an end plug 256, are linked together. According to this embodiment, the connection between individual markers is made when a ball portion 258, 260, attached to the cap 254 of one marker 250 is received within a socket portion 262, 264, built into the end plug 256 of another. A ball-and-socket connection provides a flexible, rotatable arrangement that allows the construction of a wide range of three-dimensional figures, or simply the bundling of a group of markers together for storage and transport.

Figure 17:
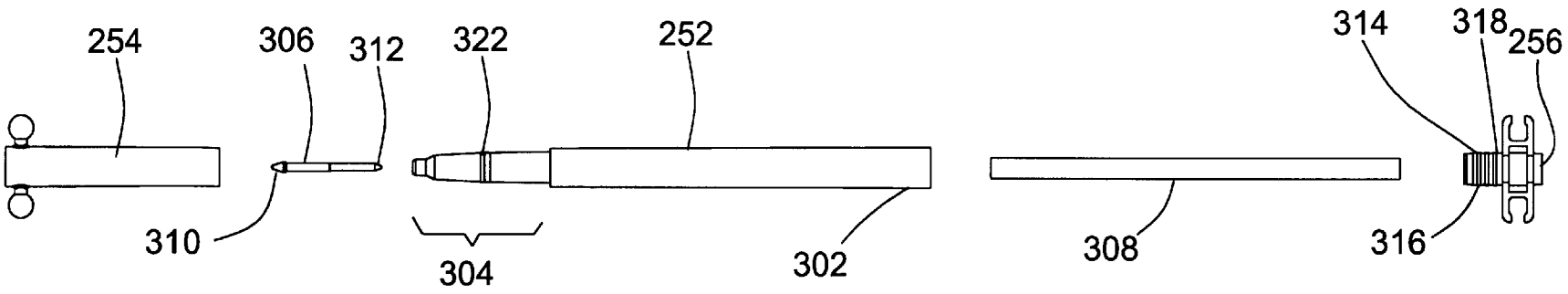
FIG. 17 is an exploded side elevational view of an individual marker assembly.

In keeping with this embodiment of the invention, each marker 250 is a writing device. As is shown in FIG. 17, each individual marker includes a body 252, a cap 254, and an end plug 256. The body 252 includes an open end 302 and a drawing end 304. The drawing end 304 receives a nib 306, and the open end 302 of the body 252 receives an ink reservoir 308. The nib 306 further includes a writing end 310 and a contacting end 312 that engages the reservoir 308, thus creating a path for ink to flow from the reservoir 308 through the nib 306 when the writing end 310 contacts a writing surface.

Figure 24:
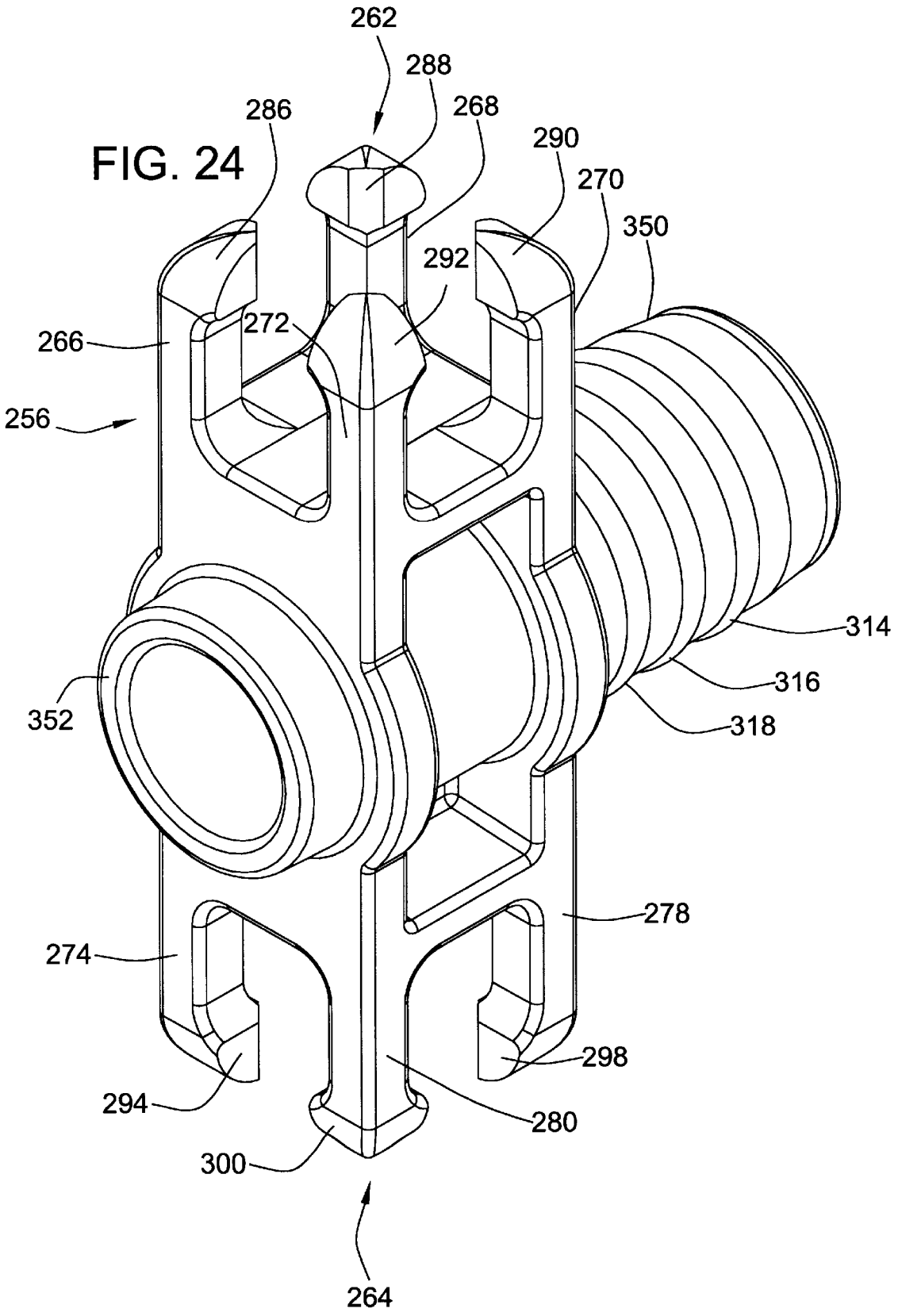
FIG. 24 is a perspective view of a marker end plug.
Figure 25:
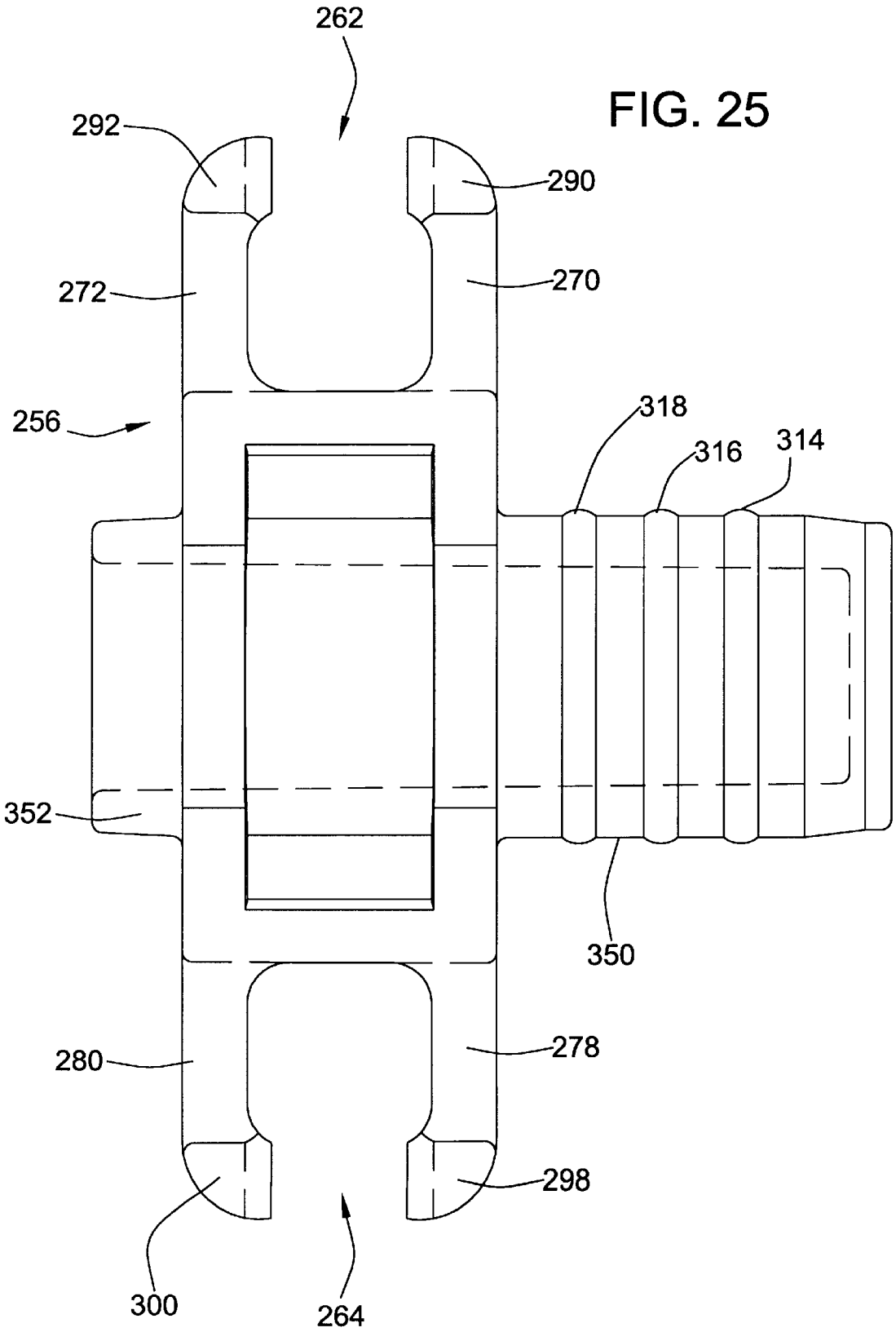
FIG. 25 is a side elevational view of the marker end plug shown in FIG. 24.
Figure 26:
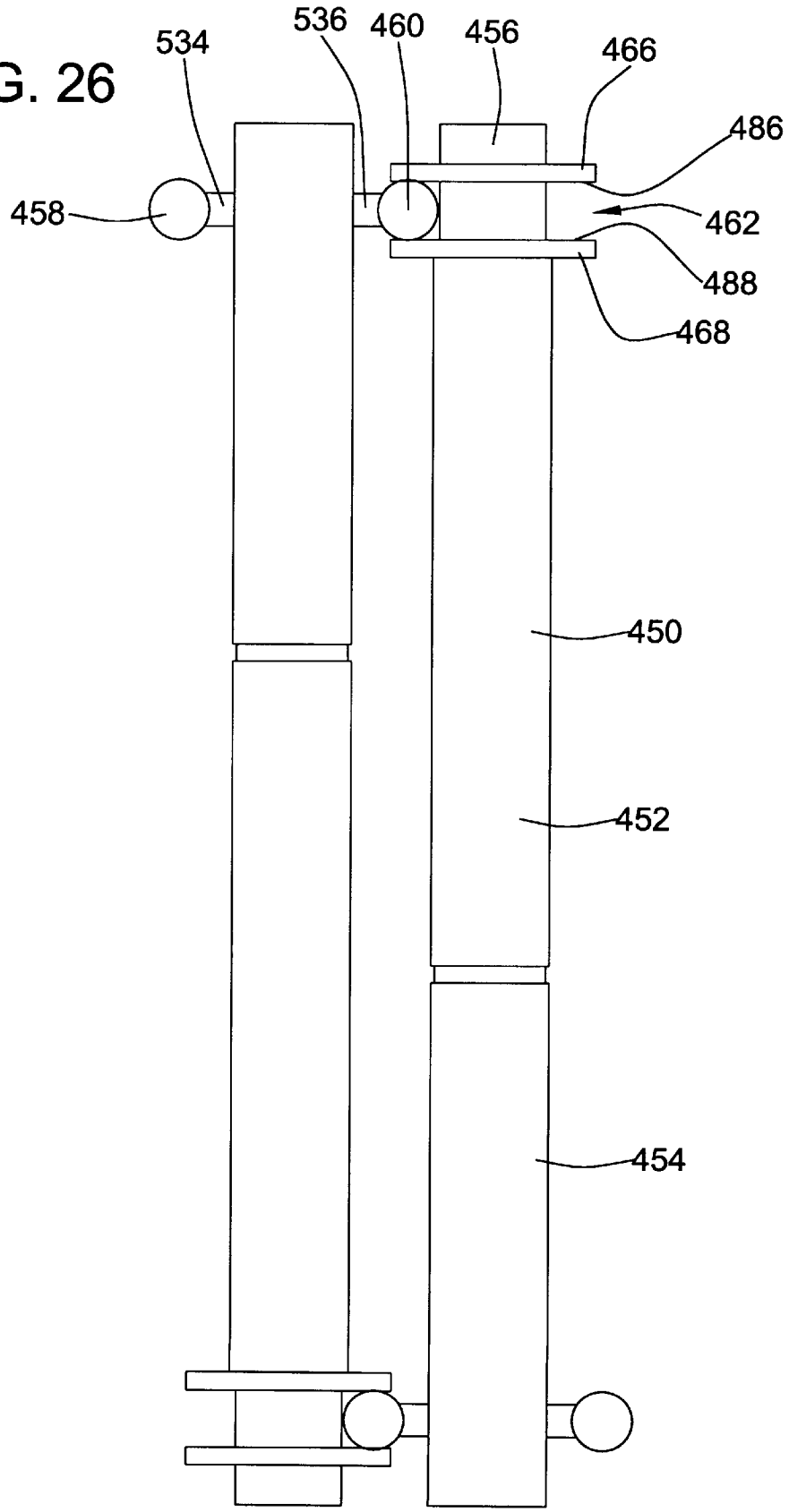
FIG. 26 is a side view of two markers linked together according to another embodiment.

In this embodiment, the end plug 256 of the marker assembly 250 is received within the open end 302 of the marker body 252. The end plug 256 seals the open end 302 of the marker body 252, which contains the ink reservoir 308. Referring to FIGS. 24 and 25, the end plug 256 includes annular ridges 314, 316, 318 that engage the interior of the open end 302 of the marker body 252, to secure and seal the end plug 256 within the marker body 252. The marker body 252 is thus sealed, to prevent the ink in the reservoir 308 from evaporating.

FIG. 17 also illustrates the end cap 254 of this embodiment, which receives the drawing end 304 of the marker body 252. The cap 254 functions to protect the nib 306 and to prevent the marker ink from evaporating when the marker is not in use. As is more clearly seen in FIG. 22, the cap 254 includes an interior annular ring 120 that interlocks with a corresponding annular ring 322, seen in FIG. 17, on the exterior of the drawing end 304 of the marker body 252. The engagement of the locking rings 320, 322 secures the cap 254 to the drawing end 304 of the marker body 252 when the marker assembly 250 is not in use.

Figure 18:
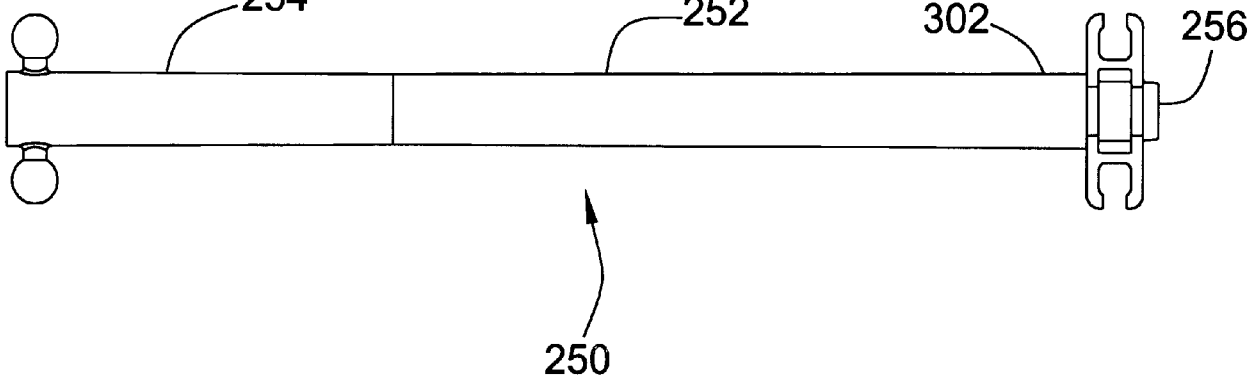
FIG. 18 is a side elevational view of an individual marker assembly.
Figure 19:
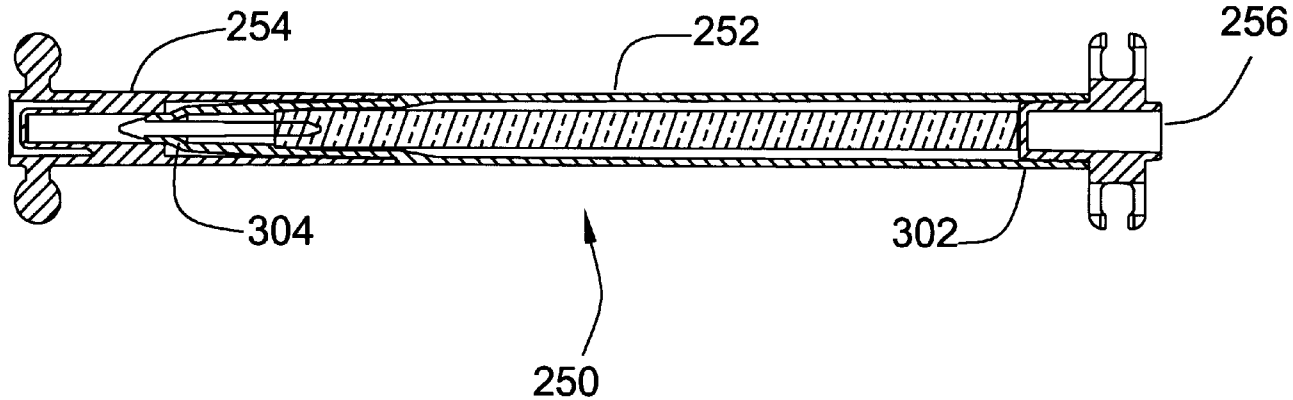
FIG. 19 is a sectional view of the individual marker assembly shown in FIG. 18.

FIG. 18 is a side view of a marker assembly 250, and illustrates the interrelationships among the assembled marker components. FIG. 19 is a sectional view of the individual marker 250 of FIG. 18. The cap 254 receives and seals the drawing end 304 of the marker body. The end plug 256 is received within the open end 302 of the marker body 252, and seals the open 302 end of the marker body 252. The cap 254 and end plug 256 prevent the ink reservoir 308 from drying out through evaporation when the marker is not in use.

Figure 20:
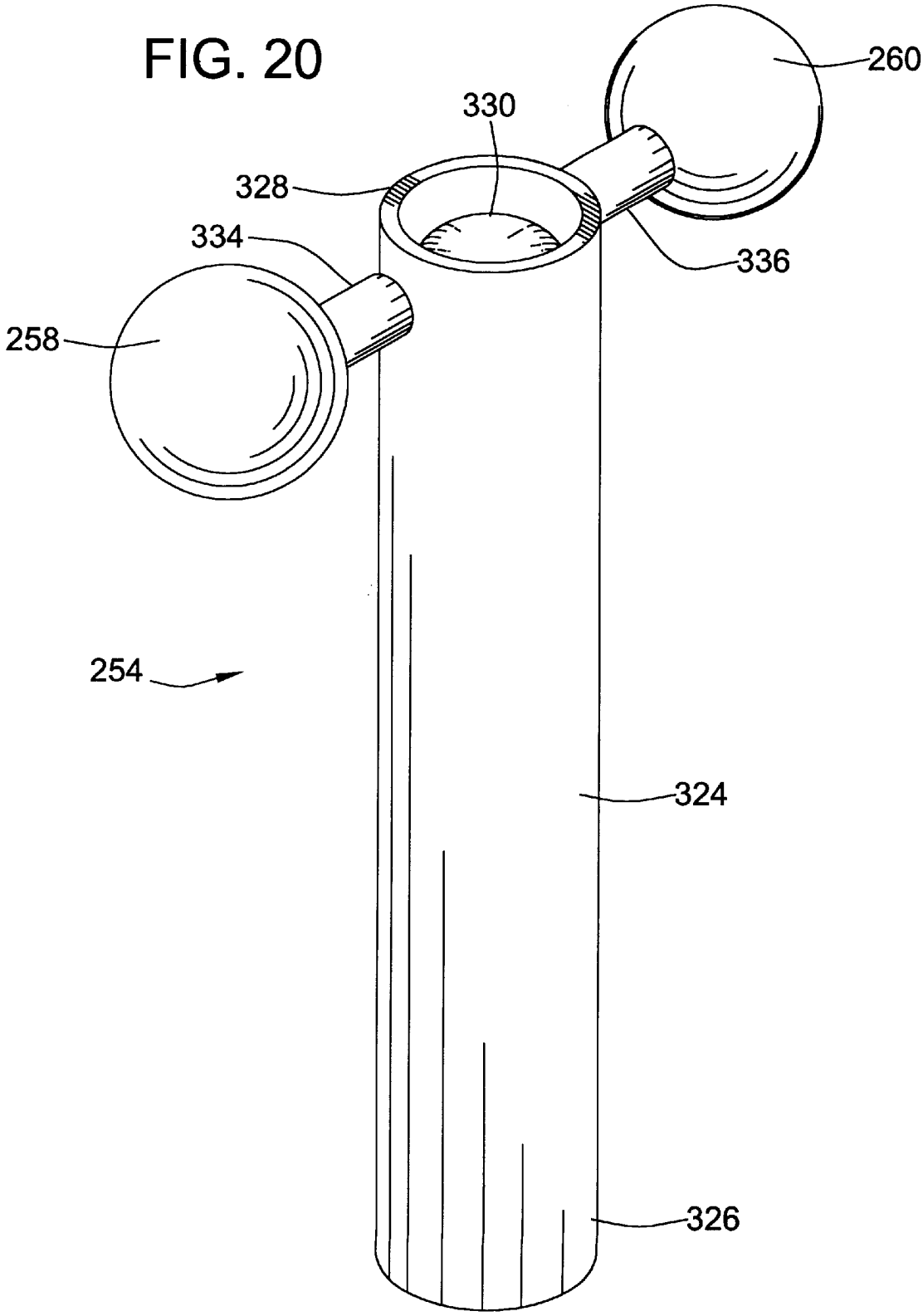
FIG. 20 is a perspective view of a ventilated marker cap, according to an embodiment of the present invention.
Figure 22:
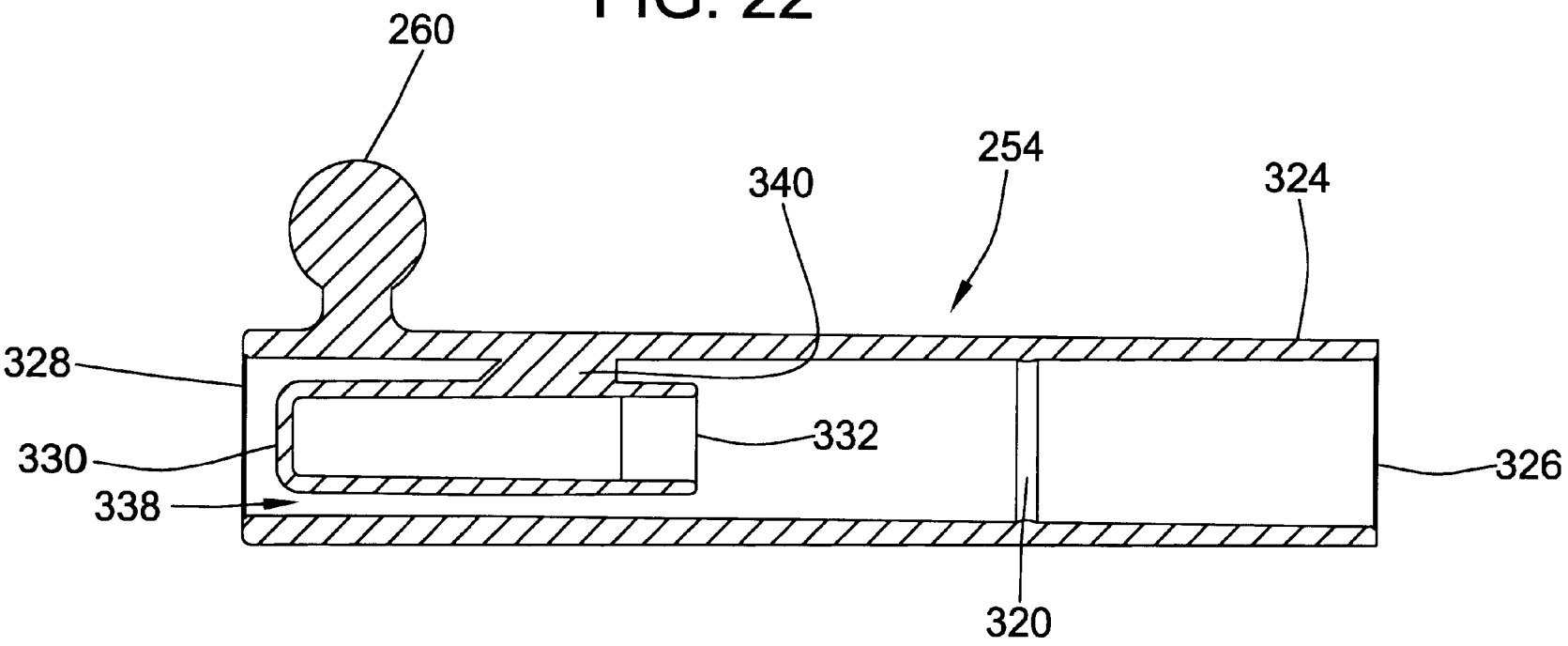
FIG. 22 is a sectional view of the ventilated marker cap, taken along line 22—22 of FIG. 21.

As is seen in FIGS. 20 and 22, the cap 254 includes an outer cylinder 324, ball portions 258, 260, an open end 326, a vented end 328, and an inner cap 330. The ball portions 258, 260 are connected to the vented end 328 of the cap 254 by means of short pegs 334, 336. In this embodiment, the pegs 334, 336 are illustrated as cylindrically shaped. However, their shapes may vary, and are they are not limited to their configuration in this illustrative embodiment.

Figure 23:
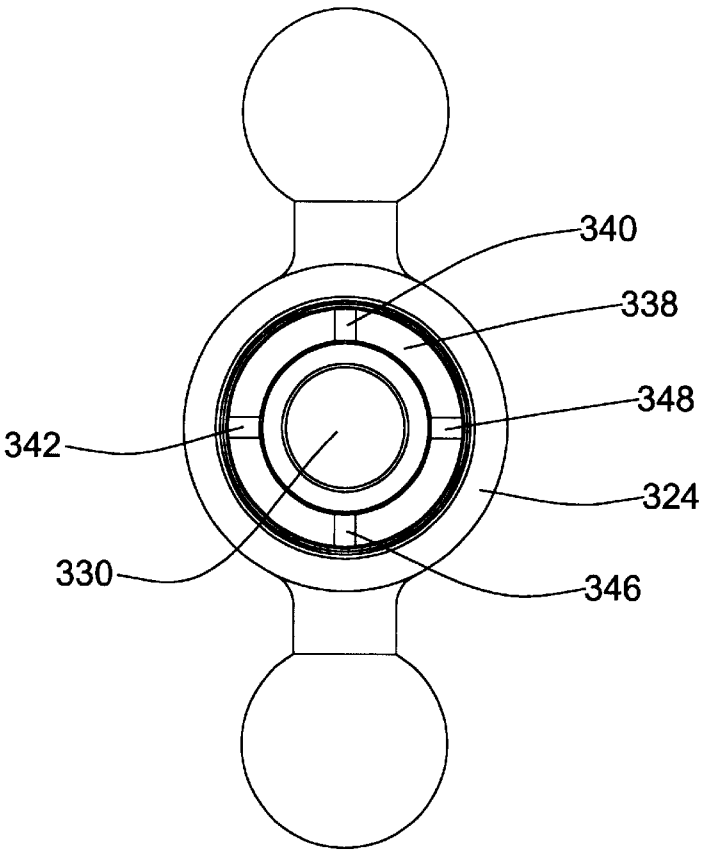
FIG. 23 is a bottom view of the ventilated marker cap shown in FIG. 20.
Figure 21:
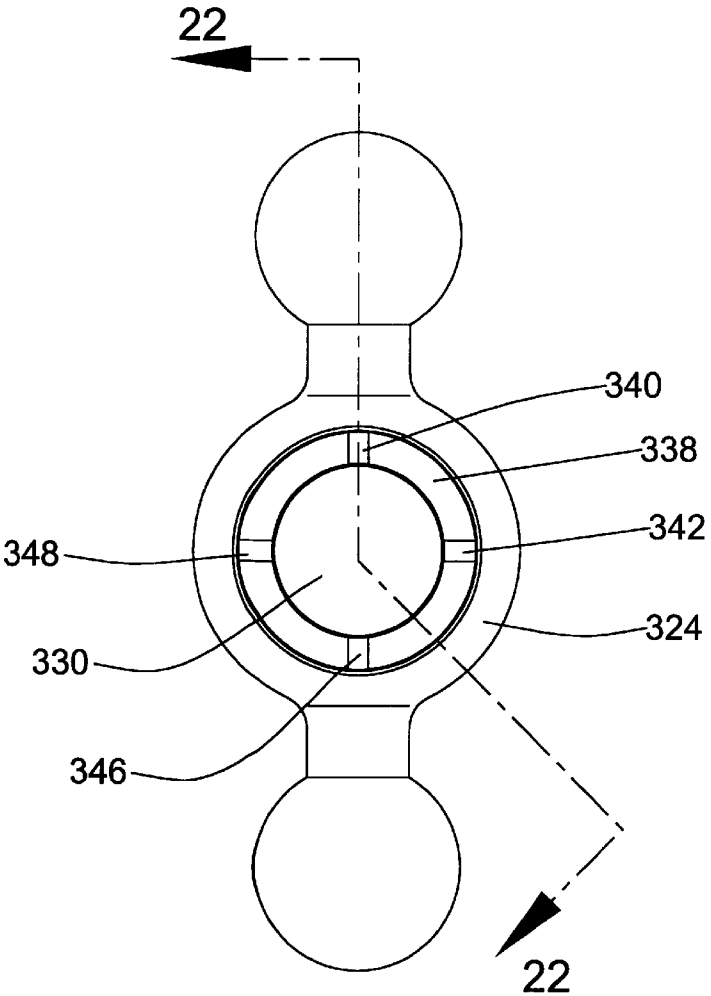
FIG. 21 is a top plan view of the ventilated marker cap shown in FIG. 20.

In this illustrative embodiment, the cap 254 may also be vented to reduce its potential choking hazard to children. If the vented cap 254 were to lodge in a child's throat, it would allow the child to safely breathe until removed. The venting may be achieved by means of a ventilation passage 338, shown in FIGS. 21–23. This passage 338 consists of the space between an inner cap 330, with an open end 332, and the outer cylinder 324, resulting from their connection in a coaxial, spaced-apart relationship by bridge portions 340, 342, 346, 348, which extend from the interior of the cap outer cylinder 324 to the exterior of the inner cap 330. FIG. 22, a sectional view along line 22—22 of FIG. 21, illustrates the connection of the inner cap 330 to the outer cylinder 324 by bridge portion 340.

In this illustrative embodiment, the inner cap 330 receives the nib 306, as the cap 254 receives the drawing end 304 of the marker body 252. This construction allows the cap 254 to protect the nib 306 and to prevent the ink from evaporating. In addition, this construction also provides a passageway for air between the inner cap 330 and outer cylinder 324, such that a child may continue breathing in the event that the cap 254 becomes lodged in the child's throat through accidental ingestion. Further, FIG. 22 illustrates an annular ring 320 disposed on the interior of the outer cylinder 324, spaced apart from the open end 326 of the cap 254. This annular ring 320 secures the cap 25.4 to the marker body 252 by interlocking with the annular ring 322, shown in FIG. 17, on the marker body 252 when the marker is not in use.

The illustrative embodiment also includes an end plug 256, as illustrated in FIGS. 24 and 25. The end plug 256 includes a tubular end 350 that is received within the open end 302 of the marker body 252. The annular ridges 314, 316, 318 on the end plug 256 engage the interior of the tubular marker body 252 so as to secure the end plug 256 in place, thus sealing the open end 302 and rendering the end plug 256 difficult to remove.

The end plug 256 of this embodiment also includes two diametrically opposed sockets 262, 264. Each socket 262, 264 is defined by prongs 266, 268, 270, 272 and 274, 276, 278, 280, respectively, and each socket 262, 264 is configured to receive a ball portion 258, 260. Each prong 266, 268, 270, 272, 274, 276, 278, 280 of this particular embodiment includes a lug 286, 288, 290, 292, 294, 296, 298, 300, respectively, that protrudes toward the interior of the socket 262, 264 formed by its associated prong. The lugs 286, 288, 290, 292, 294, 296, 298, 300 partially surround, and thus rotatably lock a ball portion 258, 260 within the socket, as is clearly seen in FIG. 16. The prongs 266, 268, 270, 272, 274, 276, 278, 280 are spaced apart from one another in order to allow rotation and relative motion of coupled markers as the short pegs 334, 336 are rotated into the spaces between adjacent prongs. In the embodiment shown, the ball-and-socket connection offers improved flexibility because the spaces between the prongs 266, 268, 270, 272, 274, 276, 278, 280 allow the ball connecting pegs 334, 336 to be rotated past the ball retaining lugs 286, 288, 290, 292, 294, 296, 298, 400 of the sockets 262, 264 as the marker is rotated.

In this embodiment, the exterior of the socket 262, 264 is square in cross-section. In other embodiments, the exterior of the socket may have other cross-sections or configurations.

According to the teachings of the invention, the actual number of sockets disposed on each end plug 256 is not limited to two, as described in this illustrative embodiment. Any number of sockets, which may ultimately be limited by production methods, may be disposed on each end plug 256. For example, the end plug may include one, three, four, five, or more sockets. Furthermore, the ball portions 258, 260 and sockets 262, 264 are not limited to the configuration described in this embodiment. The ball portions 258, 260 may also be disposed on the end plug 256, and the sockets 262, 264 may be disposed on a cap 254. Ball portions 258, 260 and sockets 262, 264 may also be disposed in various symmetrical or asymmetrical orientations relative to each other. In another alternative embodiment, each end plug 256 or cap 254 may include both ball 258, 260 and socket 262, 264 portions.

Similarly, the number of prongs or lugs defining each socket on the end plug of the illustrative embodiment is in no way meant to limit the scope or spirit of the invention. Any number of prongs or lugs can be incorporated, while still keeping within the scope of the invention. For example, each socket may include three, five, six, or more prongs or lugs.

As is seen in FIGS. 24 and 25, the end plug 256 of this embodiment also includes a raised annulet 352 that is diametrically opposed to and coaxial with the tubular end 350 of the end plug 256. The raised annulet 352 is sized so as to be slidably receivable within the open end 326 of cap 254. Friction between the annulet 352 and the cap 254 retains the cap 254 in an easily accessible location when the marker 250 is used for writing or drawing. The annulet 352 is also configured to allow easy engagement and disengagement of cap 254.

Another embodiment of the invention is shown in FIGS. 26–31. The marker 450 includes a body 452, a cap 454 and an end plug 456. The body 452, the cap 454, and the other components (except for the end plug 456) are similar to the components in the marker 50. In this embodiment, the end plug 456 has a socket 462. The socket 462 is configured to receive a ball portion 458, 460. The socket 462 includes prongs 466, 468. In this embodiment, the prongs 466, 468 have a circular configuration. In addition, the prongs 466, 468, may have lugs 486, 488 that protrude toward the interior of the socket 462 formed by its associated prong. The lugs 486, 488 partially surround, and thus rotatably lock a ball portion 458, 460 within the socket, as shown in FIGS. 26–30. The prongs 466, 468 are spaced apart from one another in order to allow rotation and relative motion of coupled markers as the short pegs 534, 536 are rotated into the space between the prongs. In this embodiment, the ball and socket connection offers flexibility because the space between the prongs 466, 468 allow the balls 458, 460 to be rotated as the marker is rotated.

Figure 27:
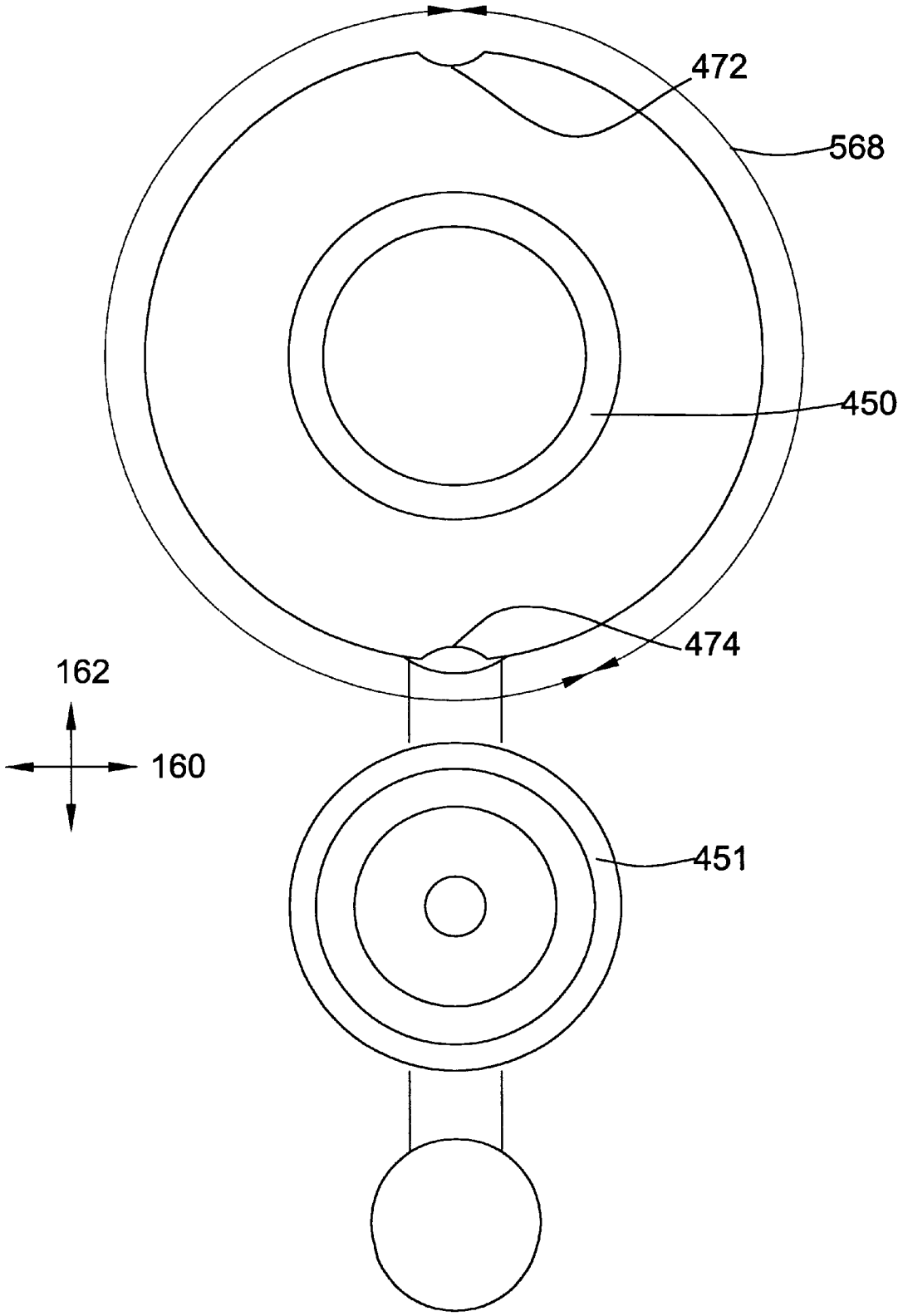
FIG. 27 is a top view of the two markers shown in FIG. 26.

In addition, the end plug 456 may include an anti-roll feature. An anti-roll feature prevents the marker 450 from rolling off of a flat surface, such as a desk. In one embodiment, the anti-roll feature may include two arcs 472, 474 on the exterior of the end plug 456 as shown in FIG. 27. Thus, if the user were to place the marker 450 without the cap 454 on a flat surface, the arcs 472, 474 would prevent the marker from rolling. In other embodiments, the anti-roll feature may be a flat area on the end plug and/or body, or may be other shapes or configurations. In addition, the marker may include any number and/or combination of anti-roll features. For example, the marker may include: one arc; three arcs; four or more arcs; one or more arcs and one or more flat areas; two flat areas; three flat areas; or four or more flat areas.

FIGS. 27–30 show views of two markers 450, 451 connected together in various positions. The markers have an X axis 160, a Y axis 162, and a vertical Z axis 164. The Y axis 162 is perpendicular to the X axis 160. The vertical Z axis 164 is perpendicular to the X axis 160 and the vertical Z axis 164 is perpendicular to the Y axis 162.

Figure 28:
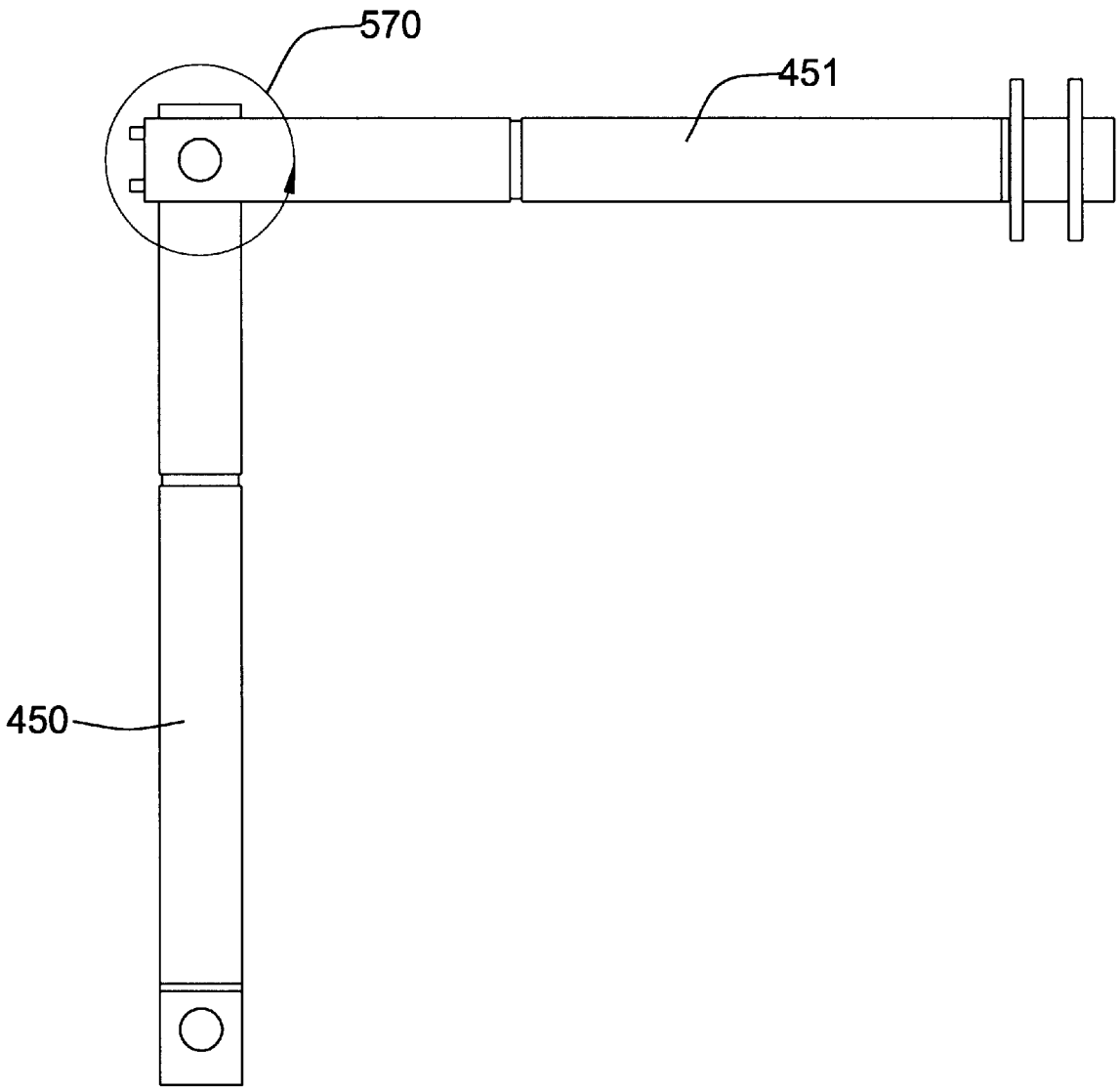
FIG. 28 is a side view of the two markers shown in FIG. 26.
Figure 28:
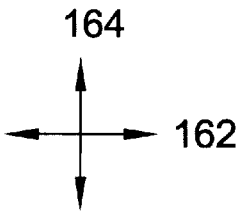
Figure 29:
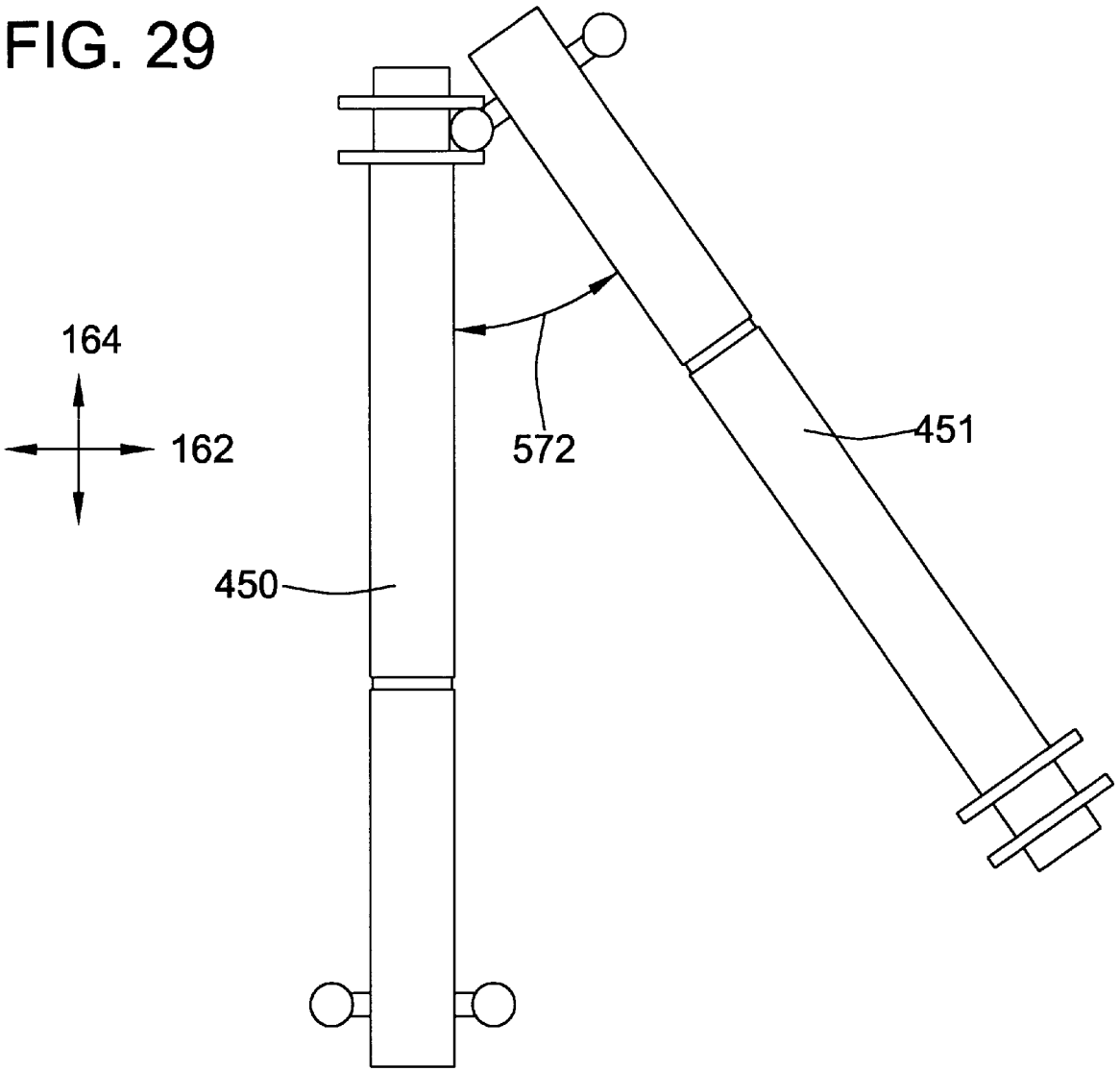
FIG. 29 is a side view of the two markers shown in FIG. 26.
Figure 30:
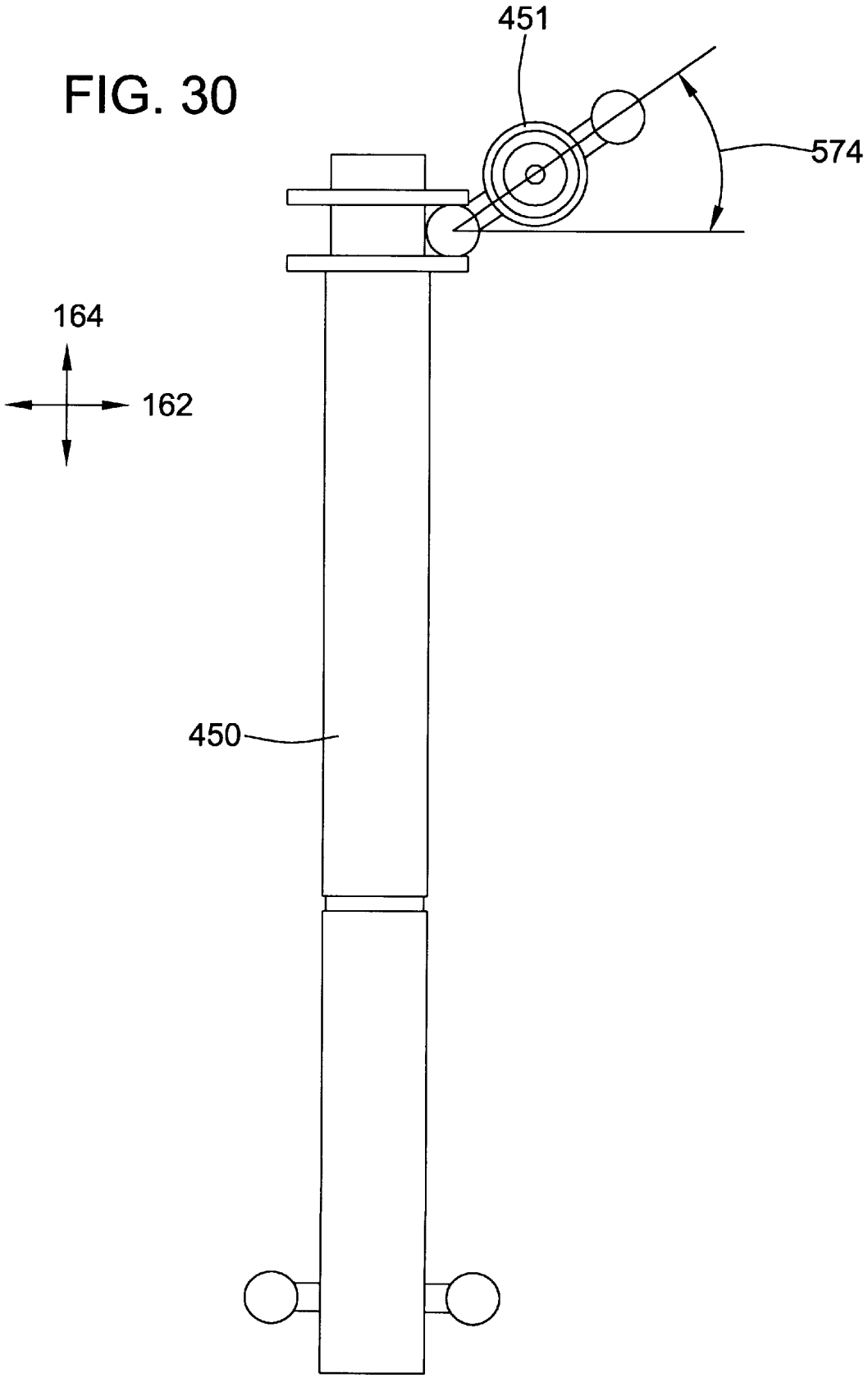
FIG. 30 is a side view of the two markers shown in FIG. 26.
Figure 31:
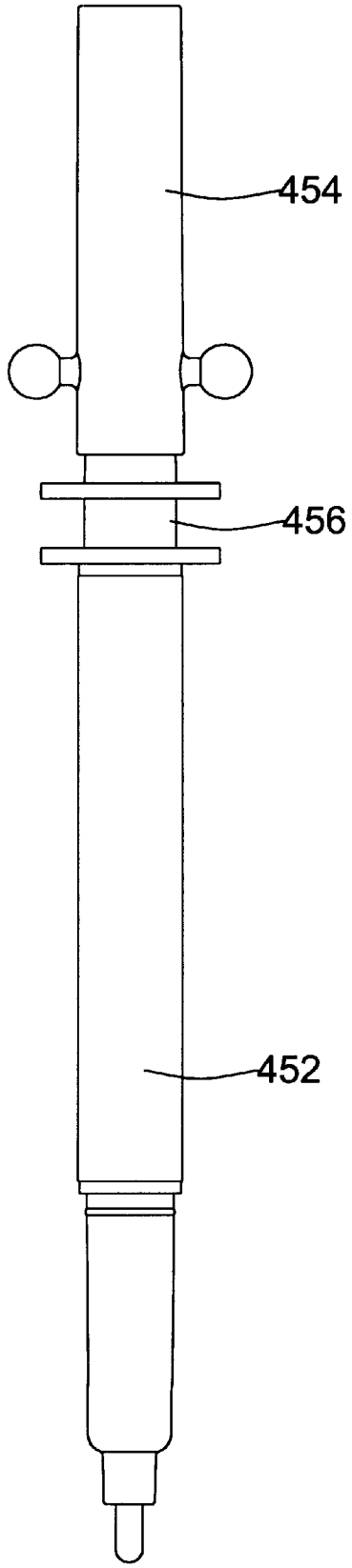
FIG. 31 is a side view of the marker cap positioned on the end plug.

Referring to FIG. 27, the markers 450, 451 are shown in a top view. The marker 451 is able to move in a range 568 of 0 to 360 degrees around the Z axis 164 relative to the marker 450. Referring to FIG. 28, the markers 450, 451 are shown in a side view. The marker 451 is able to move in a range 570 of 0 to 360 degrees around the Y axis 162 relative to marker 450. Referring to FIG. 29, the marker 451 is able to move in a range 572 of 0 to 35 degrees around the X axis 160 (in the Y-Z plane). Referring to FIG. 30, the marker 451 is able to move in a range 574 of 0 to 35 degrees around the X axis 160 (in the Y-Z plane). Referring to FIG. 31, the cap 454 may be positioned on the end plug 456 for storage during use of the marker 450.

Thus, the invention provides markers integrated with a construction system that allow a child to sketch a FIG. that she will later build using the construction toys. Conversely, the integrated markers allow a child to immediately sketch or draw a three-dimensional figure that she has built using the construction system. Combining markers with a construction toy allows a child to seamlessly integrate two-dimensional creative ideas with a spatial mode of construction and expression, and is thus desirable as an educational toy.

Additionally, integrating markers with the individual bodies of a construction system allows the markers to be linked together for storage or transit, thus eliminating the need for an additional case. It is further desirable for the construction bodies/markers to include integrated connection means such that no dedicated connectors are needed to link the markers. An integrated connection means also allows for various modes of interconnection among markers, such as rotatable connections, multiple element connections at one connection point, and the like.

Connectable markers are particularly desirable when a flexible, versatile connection means is included. For example, a flexible ball-and-socket connection has inherently more degrees of freedom than a linear or otherwise fixed connection means. This type of connection facilitates a large number of possible shapes and connection orientations. The increased versatility affords a child greater freedom of expression.

It is further desirable for the smaller components of a marker/construction system to be rendered safe for small children by means that reduce the choking hazard posed by such smaller components.

A marker is merely an exemplary embodiment of this invention, and as such, does not limit the scope of the invention. The invention may be practiced with other types of writing devices such as pens, colored pencils, and crayons. In another embodiment, each writing instrument may include a plurality of shaft-like ends that facilitate coupling of separate elements. Further, each end of any embodiment of the invention may include a combination of ball and socket portions, or each end may only contain either ball portions or socket portions, without deviating from the scope or spirit of the invention.

Moreover, the invention is not limited to a writing device. It can also be embodied simply as a non-drawing toy construction set including a plurality of uniformly shaped, connectable elements.

While particular embodiments of the invention have been shown, it will be understood, of course, that the invention is not limited thereto. On the contrary, we intend to cover all alternatives, modifications and equivalents as may be included within the scope and spirit of the invention as defined by the appended claims.

What is claimed is:

1. A set of connectable writing devices comprising:

a plurality of shaft-like writing devices, each writing device comprising a body, the body including a drawing end and an open end, each writing device further comprising a cap, the cap including a first end and a second end, wherein the first end is sized to receive the writing end of the body, each writing device further comprising an end plug attached to the open end of the body, a first connector portion disposed on the cap and protruded therefrom in a direction perpendicular to the writing device, a second connector portion disposed on the end plug and protruded therefrom in a direction perpendicular to the writing device, the second connector portion configured to receive a first connector portion.

2. The writing device set of claim 1, wherein the first connector portion comprises a sphere and the second connector portion comprises a socket, the socket configured to releasably receive a sphere.

3. The writing device set of claim 2, wherein the cap further includes an inner cap disposed within the second end of the cap, the inner cap further including an open end aligned with the first end of the cap, the open end of the inner cap sized to receive the writing end of the body.

4. The writing device set of claim 3, wherein bridge portions connect the inner cap to the cap such that a fluid passageway results between the inner cap and the cap.

5. The writing device set of claim 4, wherein the socket further comprises a plurality of prongs extending outwardly from the end plug, each prong including a free end.

6. The writing device set of claim 5, wherein at least one prong includes a locking lug disposed on the free end of the prong, such that the lug locks a received sphere in place within the socket.

7. The writing device set of claim 6, wherein the plug further includes a protruding tubular end that is receivable by the open end of the body, the tubular end of the plug further including an annular locking ridge.

8. The writing device set of claim 7, wherein the plug further includes a protruding annulet that is receivable by the first end of the cap.

9. The writing device set of claim 8, wherein each writing device is identical in shape.

10. A set of connectable writing devices comprising:

a plurality of shaft-like writing devices, each writing device comprising a body, the body including a writing end and an open end, each writing device further comprising a cap that includes a first end and a second end, the first end sized to receive the writing end of the body, each writing device further comprising an end plug attached to the open end of the element, a plurality of first connector portions affixed to the cap and end plug and protruded therefrom in a direction perpendicular to the writing device, a plurality of second connector portions affixed to the cap and end plug and protruded therefrom in a direction perpendicular to the writing device, the second connector portions configured to interlock with the first connector portions.

11. The writing device set of claim 10, wherein the first connector portion comprises a sphere and the second connector portion comprises a socket, the socket configured to releasably receive the sphere.

12. The writing device set of claim 11, wherein the cap further includes an inner cap disposed within the second end of the cap, the inner cap comprising an open end aligned with the first end of the cap, the open end of the inner cap sized to receive the writing end of the body.

13. The writing device set of claim 12, wherein the inner cap is attached to the cap by bridge portions, such that a fluid passageway results between the inner cap and the cap.

14. The writing device set of claim 13, wherein the socket comprises a plurality of prongs extending outwardly from the end plug, each prong including a free end.

15. The writing device set of claim 14, wherein at least one prong includes a locking lug disposed on the free end of the prong, such that the lug locks the received sphere in place within the socket.

16. The writing device set of claim 15, wherein the end plug further comprises a protruding tubular end that is receivable by the open end of the body, the tubular end of the plug further including an annular locking ridge.

17. The writing device set of claim 16, wherein the end plug further comprises a protruding annulet that is receivable by the first end of the cap.

18. The writing device set of claim 17, wherein each writing device is identical in shape.

* * * * *